US008489005B2

(12) United States Patent
Mizuno

(10) Patent No.: US 8,489,005 B2
(45) Date of Patent: Jul. 16, 2013

(54) IMAGE FORMING APPARATUS, ALIGNMENT PATTERN FORMING METHOD, AND COMPUTER-READABLE RECORDING MEDIUM HAVING TONER IMAGE ALIGNMENT PROGRAM RECORDED THEREIN

(75) Inventor: Masanaka Mizuno, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 304 days.

(21) Appl. No.: 13/015,095

(22) Filed: Jan. 27, 2011

(65) Prior Publication Data

US 2011/0182600 A1 Jul. 28, 2011

Related U.S. Application Data

(60) Provisional application No. 61/299,077, filed on Jan. 28, 2010.

(51) Int. Cl.
*G03G 15/01* (2006.01)

(52) U.S. Cl.
USPC ..... 399/301

(58) Field of Classification Search
USPC ..... 399/49, 72, 301; 347/116
See application file for complete search history.

(56) References Cited

U.S. PATENT DOCUMENTS

| | | | | |
|---|---|---|---|---|
| 7,162,171 | B2 * | 1/2007 | Sugiyama | 399/49 |
| 8,050,603 | B2 * | 11/2011 | Yamada et al. | 399/301 |
| 2005/0286922 | A1 | 12/2005 | Oki | |

* cited by examiner

*Primary Examiner* — William J Royer
(74) *Attorney, Agent, or Firm* — Turocy & Watson, LLP

(57) ABSTRACT

Generally, according to an embodiment, an image forming apparatus includes an image forming unit, a belt, a sensor whose detection area for a toner image is set on a belt surface, and an image control unit. The image control unit controls the image forming unit to form a toner image to be transferred to a sheet in a range different from the detection area in a direction of belt width, and to form alignment patterns at a position which is within a range where the toner image is formed in the direction of belt surface movement and which overlaps the detection area in the direction of belt width.

20 Claims, 22 Drawing Sheets

FIG.10

| TYPE OF SHIFT | QUANTITY OF SHIFT (MEASURING PITCH) x=m,c,k | TARGET OF CORRECTION |
|---|---|---|
| SHIFT IN PARALLELISM IN SUB SCANNING DIRECTION | Py−m、Pm−c、Pc−k | WRITING START POSITION OF LASER (SUB SCANNING DIRECTION) |
| SHIFT IN PARALLELISM IN MAIN SCANNING DIRECTION | [Wx-r]−[Wy-r] | WRITING START POSITION OF LASER (MAIN SCANNING DIRECTION) |
| SHIFT IN MAGNIFICATION IN MAIN SCANNING DIRECTION | [Wx-r]+[Wy-f])-([Wy-r]+[Wy-f] | IMAGE WRITING FREQUENCY |
| SHIFT IN INCLINATION | Sx | ANGLE OF REFLECTION MIRROR |

IMAGE FORMING APPARATUS, ALIGNMENT PATTERN FORMING METHOD, AND COMPUTER-READABLE RECORDING MEDIUM HAVING TONER IMAGE ALIGNMENT PROGRAM RECORDED THEREIN

CROSS-REFERENCE TO RELATED APPLICATION

This application is based upon and claims the benefit of priority from U.S. provisional application 61/299,077, filed on Jan. 28, 2010, the entire contents of which are incorporated herein by reference.

FIELD

Embodiments described herein relate generally to techniques of an image forming apparatus, an alignment pattern forming method, and a computer-readable recording medium having a toner image alignment program recorded therein.

BACKGROUND

Conventionally, an image forming apparatus is known in which images of individual colors are formed on photoconductive drums by a laser optical system, then the images of the individual colors are superimposed on a transfer belt to form one color image, and the color image is transferred to a sheet. In the image forming apparatus, at the time of warm-up such as when power is turned on or at the time of recovery from sleep, relative misalignment between components of the laser optical system is generated by temperature rise within the apparatus and may cause a shift between the superimposed images of the individual colors. Therefore, alignment of the images of the individual colors is carried out at the time of warm-up.

The shift between the images of the individual colors may also be caused by relative misalignment between the components of the laser optical system due to the lapse of time. Therefore, alignment is also carried out when a prescribed number of sheets is reached in copying, and when a prescribed operation time is reached in copying and the ready state.

However, in the conventional image forming apparatus, the formation of color images must be waited for or interrupted in order to carry out alignment.

BRIEF DESCRIPTION OF THE DRAWINGS

FIG. 10 shows the type of shift, the quantity of shift and the target of correction.

DETAILED DESCRIPTION

Figure 1:
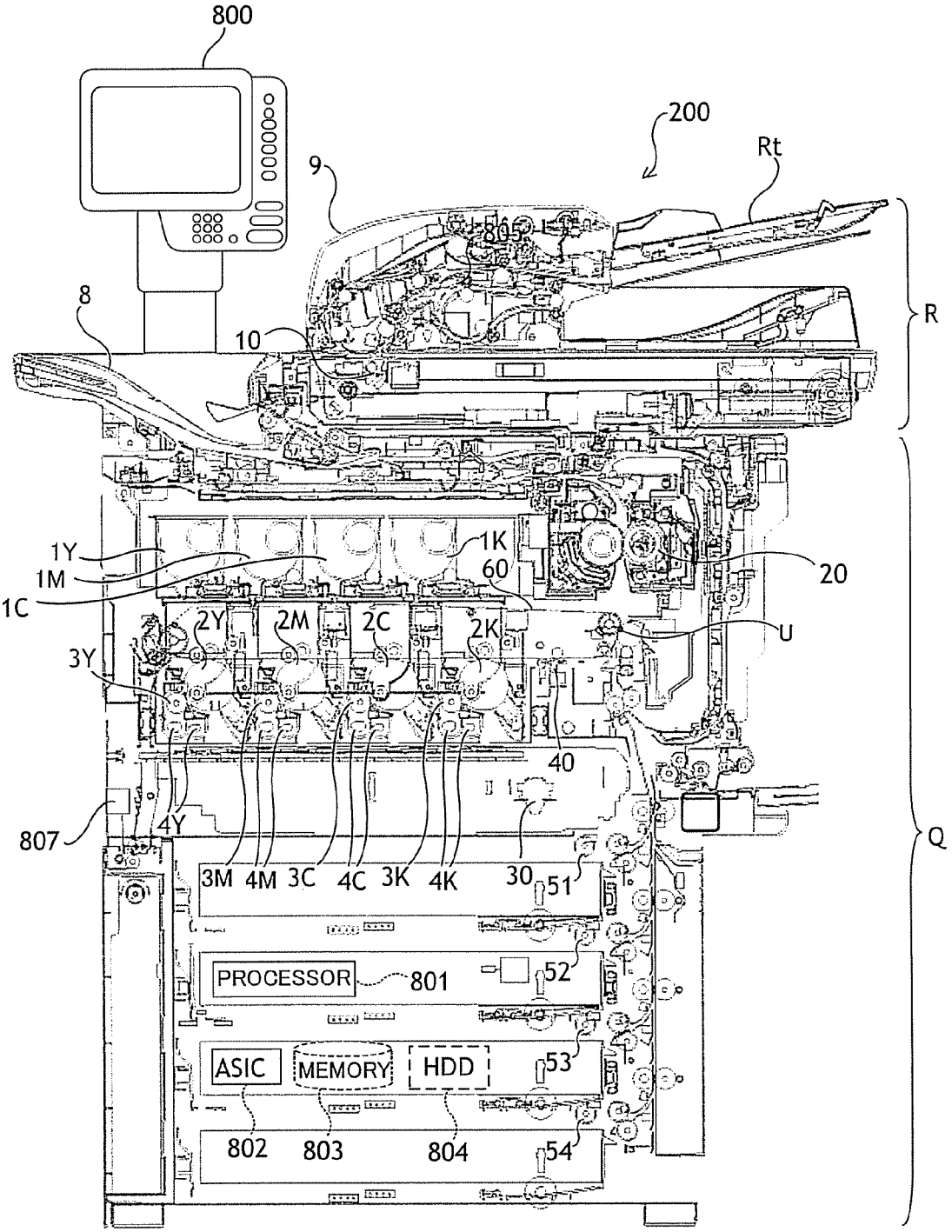
FIG. 1 is a sectional view showing an image forming apparatus.

Generally, according to an embodiment, an image forming apparatus includes: an image forming unit which forms a toner image made up of toners of plural colors; a belt which transfers to a sheet the toner image transferred to a belt surface by the image forming unit; a sensor whose detection area for the toner image is set closely to at least one end part in a direction of belt width orthogonal to a direction of belt surface movement; and an image control unit which controls the image forming unit to form the toner image to be transferred to the sheet in a range different from the detection area in the direction of belt width, and to form plural alignment patterns for toner image alignment made up of toners of different colors from each other at a position which is within a range where the toner image is formed in the direction of belt surface movement and which overlaps the detection area in the direction of belt width.

Generally, according to another embodiment, an alignment pattern forming method is a method for forming an alignment pattern for toner image alignment in an image forming apparatus having an image forming unit which forms a toner image made up of toners of plural colors, a belt which transfers to a sheet the toner image transferred to a belt surface by the image forming unit, and a sensor whose detection area for the toner image is set closely to at least one end part in a direction of belt width orthogonal to a direction of belt surface movement. The method includes forming the toner image to be transferred to the sheet in a range different from the detection area in the direction of belt width, and forming plural alignment patterns made up of toners of different colors from each other at a position which is within a range where the toner image is formed in the direction of belt surface movement and which overlaps the detection area in the direction of belt width.

Generally, according to still another embodiment, a computer-readable recording medium has a toner image alignment program recorded therein which causes a computer to execute alignment of a toner image in an image forming apparatus having an image forming unit which forms a toner image made up of toners of plural colors, a belt which transfers to a sheet the toner image transferred to a belt surface by the image forming unit, and a sensor whose detection area for the toner image is set closely to at least one end part in a direction of belt width orthogonal to a direction of belt surface movement. The recording medium has the toner image alignment program recorded therein which causes the computer to execute: forming the toner image to be transferred to the sheet in a range different from the detection area in the direction of belt width, and forming plural alignment patterns for toner image alignment made up of toners of different colors from each other at a position which is within a range where the toner image is formed in the direction of belt surface movement and which overlaps the detection area in the direction of belt width; and correcting at least one of setting related to the formation of the toner image to be transferred to the sheet and setting of the image forming unit related to the formation of the toner image to be transferred to the sheet, based on a result of detection of the alignment patterns by the sensor.

First Embodiment

Hereinafter, a first embodiment will be described with reference to the drawings.

FIG. 1 is a sectional view showing an image forming apparatus 200.

The image forming apparatus 200 is an MFP (multi-function peripheral) capable of handling A3-Wide sheets (sheet of A3-Wide size, hereinafter meaning the same), and has an image reading unit R and an image forming unit Q. The image reading unit R scans and reads an image of a sheet document or book document.

The image forming unit Q forms a toner image on a sheet, based on the image read from the document by the image reading unit R or print data transmitted from an external device to the image forming apparatus 200.

The image reading unit R has an ADF (automatic document feeder) 9 which automatically carries a document to a predetermined image reading position. The image reading unit R reads an image of a document that is automatically carried by the ADF 9 and placed on a document tray Rt (predetermined document placing table) or a document placed on a document table, not shown, using a scanning optical system 10.

The image forming unit Q has toner cartridges 1Y, 1M, 1C, and 1K, pickup rollers 51 to 54, a laser optical system 30, photoconductive members 2Y, 2M, 2C, and 2K, developing rollers 3Y, 3M, 3C, and 3K, mixers 4Y, 4M, 4C, and 4K, an intermediate transfer belt 60, a fixing device 20, and a discharge tray 8.

The image forming apparatus 200 also has a processor (control unit) 801, an ASIC 802, a memory 803, an operation display unit 800, and a communication unit 807.

The processor 801 has the role of performing various kinds of processing in the image forming apparatus 200 and also has the role of executing programs stored in the memory 803 and thus realizing various functions. The processor 801 can also be realized by a CPU (central processing unit) or MPU (micro processing unit) capable of executing equivalent arithmetic processing. The memory 803 may be, for example, a RAM (random access memory), ROM (read only memory), DRAM (dynamic random access memory), SRAM (static random access memory), or VRAM (video RAM), and has the role of storing various kinds of information and programs used in the image forming apparatus 200. An HDD 804 can be replaced by a storage device, for example, a flash memory or the like.

Various settings are displayed on the operation display unit 800. The various settings are changed by operating the operation display unit 800. The operation display unit 800 may be a touch panel system. The operation display unit 800 can include, for example, an LCD (liquid crystal display), EL (electronic luminescence), PDP (plasma display panel), CRT (cathode ray tube) or the like. The operation display unit 800 may be divided into a display unit such as an LCD, and an operation input unit. The operation input unit can include, for example, a keyboard, mouse, touch panel, touchpad, graphics tablet, dedicated button or the like.

Hereinafter, an outline of copying will be described as an example of processing in the image forming apparatus 200.

First, a sheet picked up from a cassette by the pickup rollers 51 to 54 is supplied into a sheet carrying path. The sheet carried into the sheet carrying path is carried in a predetermined carrying direction by plural roller pairs.

Then, an image of plural sheets of a sheet document that are continuously automatically carried by the ADF 9 is read by the scanning optical system 10 at the predetermined image reading position.

Figure 2:
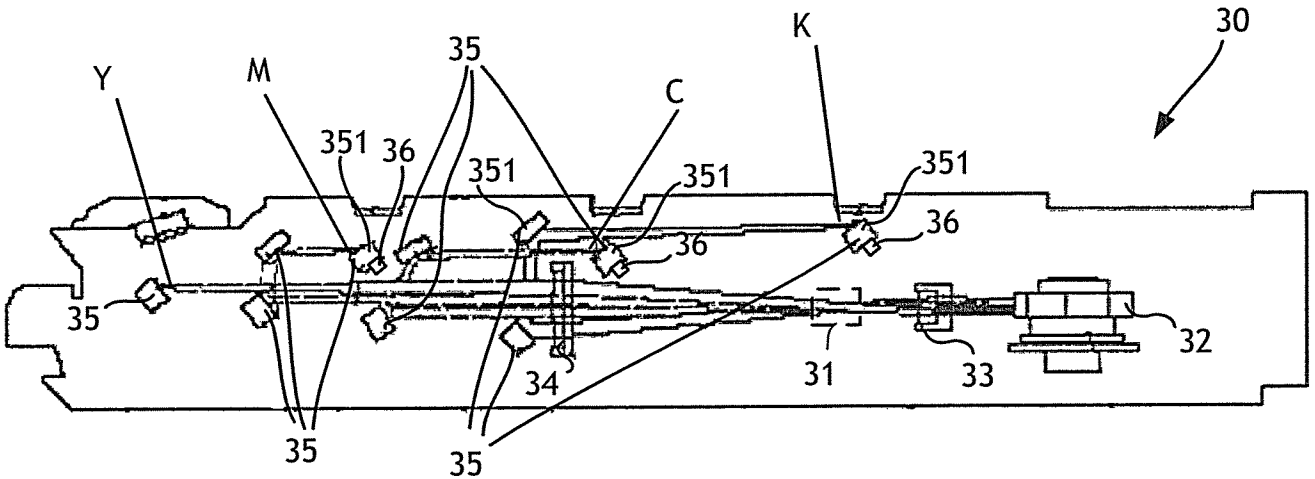
FIG. 2 shows the configuration of a laser optical system.

Next, based on the image data read from the document by the image reading unit R, the laser optical system 30 under the control of the processor 801 forms electrostatic latent images as foundations for yellow (Y), magenta (M), cyan (C) and black (K) toner images on the photoconductive surfaces of the photoconductive members 2Y, 2M, 2C and 2K. Specifically, laser beams of the individual colors emitted from a semiconductor laser element 31 (light source) based on the image data are reflected by a polygon mirror 32 and then corrected by lenses 33 and 34, as shown in FIG. 2. In FIG. 2, the semiconductor laser element 31 is shown behind the polygon mirror 34 and the lenses 33 and 34 in FIG. 2. The corrected laser beams of the individual colors are reflected by different reflection mirrors 35 corresponding to the individual colors and exposed to the photoconductive members 2Y, 2M, 2C, and 2K. As for the reflection mirrors 35, the Y laser beam uses one reflection mirror and the M, C and K laser beams use three reflection mirrors each. Of the reflection mirrors 35 reflecting the M, C and K laser beams, each reflection mirror 35 that reflects the laser beam for the third time has its inclination angle adjusted by each mirror motor 36 (driving unit). The setting of the inclination angle of the reflection mirrors 35 by the mirror motors 36 is corrected by the processor 801.

Back to FIG. 1, the toner stirred by the mixers 4Y, 4M, 4C, and 4K in the developing devices is supplied by the developing rollers 3Y, 3M, 3C, and 3K to the photoconductive members 2Y, 2M, 2C, and 2K on which the electrostatic latent images are formed. Thus, the electrostatic latent images formed on the photoconductive surfaces of the photoconductive members 2Y, 2M, 2C, and 2K are developed.

The images of the individual colors as the toner images of the individual colors formed on the photoconductive members 2Y to 2K are superimposed and transferred (so-called primary transfer) in the order of Y, M, C and K on the belt surface of the intermediate transfer belt 60, thus forming a color image (toner image to be transferred to a sheet). The color image carried by the turning of the intermediate transfer belt 60 is transferred onto the sheet that is carried, at a predetermined secondary transfer position U.

The color image transferred to the sheet is heated and fixed to the sheet by the fixing device 20. The sheet to which the color image is heated and fixed is carried through the carrying path by plural carrying rollers and sequentially discharged onto the discharge tray 8.

A sensor 40 is provided at a position facing the outer circumferential surface of the intermediate transfer belt 60 between the photoconductive member 2K and the secondary transfer position U in the turning direction of the endless loop-like intermediate transfer belt 60 (hereinafter referred to as the belt 60). The sensor 40 is for carrying out alignment of the images of the individual colors forming the color image. The sensor 40 detects the toner images on the belt 60 and outputs a detection signal to the processor 801.

Figure 3:
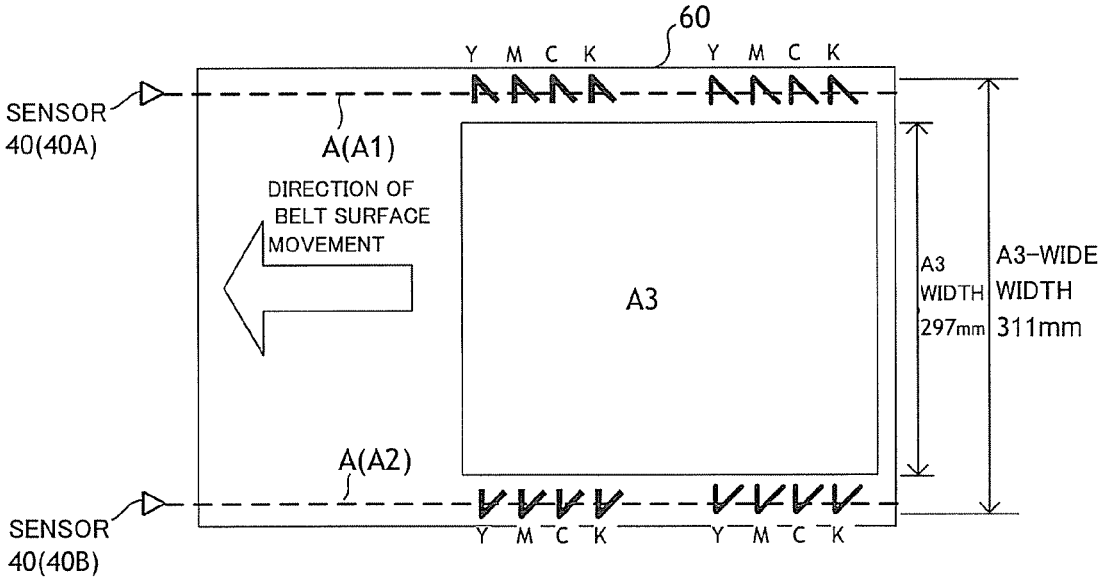
FIG. 3 is a view for explaining sensors.

FIG. 3 is a view for explaining the sensor 40.

The sensor 40 includes two sensors 40A and 40B. The sensors 40A and 40B have a detection area A (A1, A2) on the belt 60 where the sensors 40A and 40B can detect the toner images. As indicated by chain-dotted lines in FIG. 3, the detection area A1 of the one sensor 40A is set on one edge in the direction of belt width (direction orthogonal to the direction of belt surface movement). The detection area A2 of the other sensor 40B is set on the other end in the direction of belt width. The sensor 40 can only detect toner images located within predetermined narrow ranges in the direction of belt surface movement. However, the movement of the belt surface creates an equivalent to a state where the detection areas A are extending in the direction of belt surface movement, as shown in FIG. 3.

The image forming apparatus 200 is capable of handling A3-Wide sheets and can write across the A3-Wide width (331 mm) in the direction of belt width. Specifically, the detection areas A are set outside of the A3 width (297 mm) and within the A3-Wide width in the direction of belt width. Alignment patterns of the individual colors Y, M, C and K (plural alignment patterns for toner image alignment made up of toners of different colors) to correct misalignment between images of the individual colors are formed at positions overlapping the detection areas A. The sensor 40 detects these alignment patterns.

Figure 4:
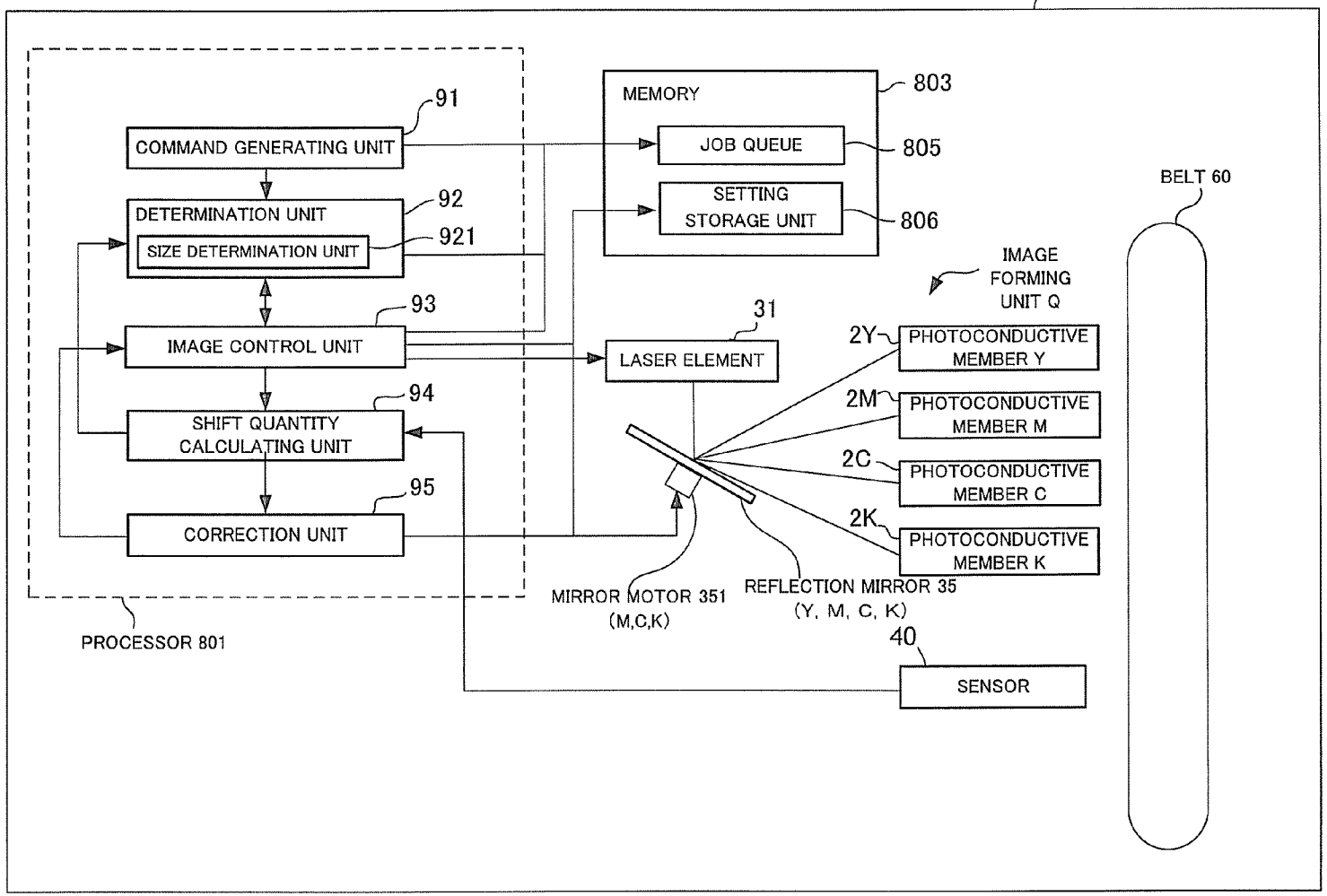
FIG. 4 is a block diagram for explaining a functional unit realized by a processor.

FIG. 4 is a block diagram for explaining functional units 91 to 95 realized by the processor 801, and the memory 803.

The processor 801 controls the entire image forming apparatus 200 including the image forming unit Q. The image forming apparatus 200 has plural functional units 92 to 95 in addition to a command generating unit 91 which generates an alignment command to designate alignment, as functions realized by the processor 801 reading programs in the memory 803.

The memory 803 has a job queue 805 and a setting storage unit 806.

The job queue 805 stores jobs and the order of jobs.

The setting storage unit 806 stores various setting values used by the processor 801 to control the semiconductor laser element 31.

Figure 5:
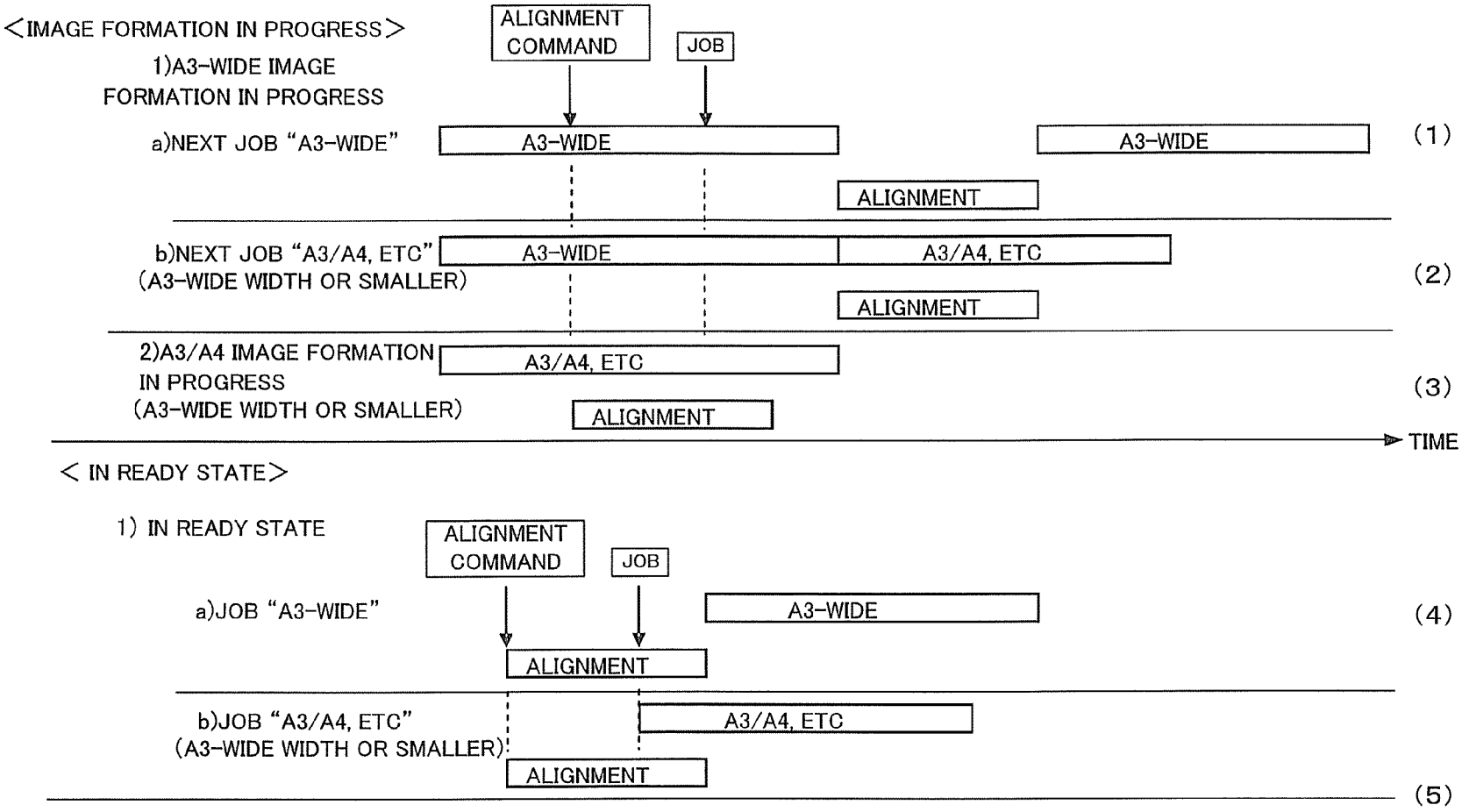
FIG. 5 shows alignment under each condition.

FIG. 5 shows alignment under each condition.

Alignment is roughly divided into five cases (1) to (5).

(1) First, alignment in the case where, when an alignment command is generated by the command generating unit 91, a job for an A3-Wide sheet is being executed and the next job is for an A3-Wide sheet, too, will be described.

In this case, the processor 801 performs alignment after the job, and then executes the next job.

Figure 6:
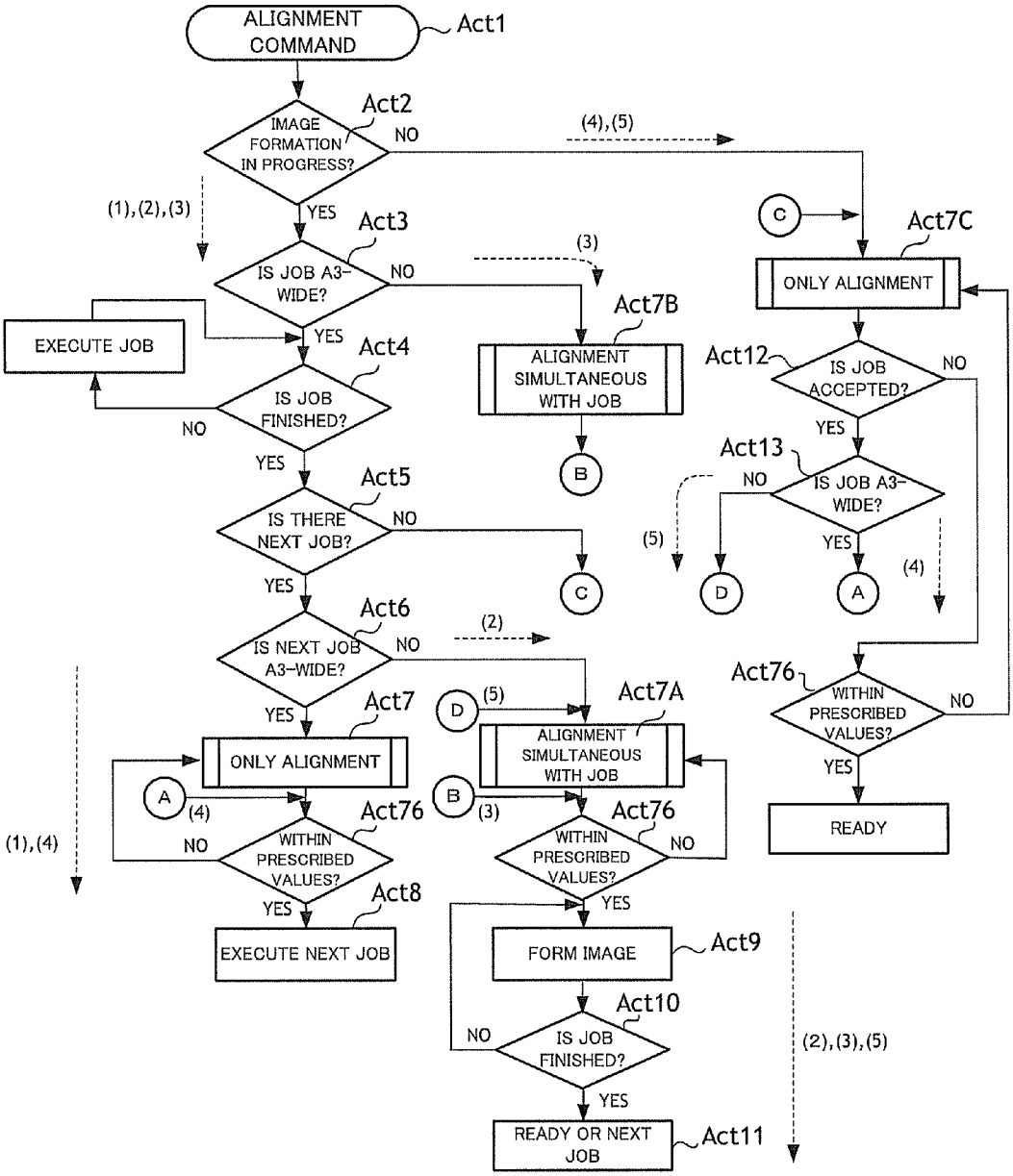
FIG. 6 is a flowchart showing a flow of the alignment by the processor.

Hereinafter, a flow of the alignment by the processor 801 in the case (1) will be described with reference to the flowchart of FIG. 6.

The command generating unit 91 generates an alignment command when a prescribed number of sheets in copying is reached (ACT 1).

After ACT 1, the determination unit 92 determines whether image formation is in progress or not (ACT 2). When it is determined that image formation is in progress (ACT 2, YES), a size determination unit 921 determines the size of the color image of the job that is currently being executed (the size of the image when the image is transferred to the sheet), referring to the job queue 805 (ACT 3).

When the size determination unit 921 determines that the size of the color image that is currently being executed is A3-Wide (ACT 3, YES), the determination unit 92 determines whether the job is finished or not (ACT 4). When it is determined that the job is finished (ACT 4, YES), the determination unit 92 determines whether there is a next job or not, referring to the job queue 805 (ACT 5).

When the determination unit 92 determines that there is a next job (ACT 5, YES), the size determination unit 921 determines the size of the color image of the next job (ACT 6).

When the size determination unit 921 determines that the size of the color image of the next job is A3-Wide (ACT 6, YES), the processor 801 performs alignment between the images of the individual colors formed by the image forming unit Q before executing the next job (ACT 7).

Figure 7:
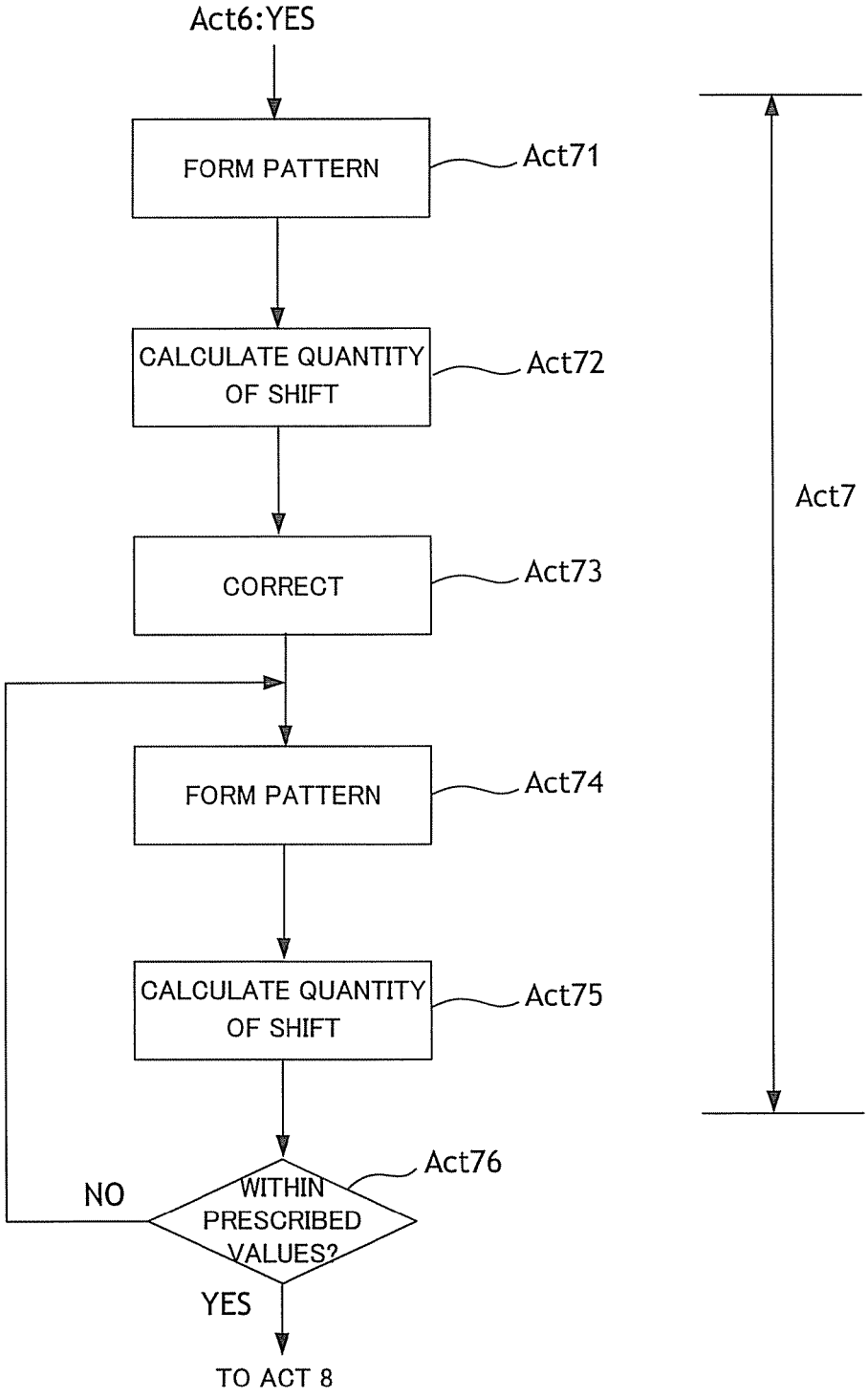
FIG. 7 is a flowchart for specifically explaining the alignment.
Figure 8:
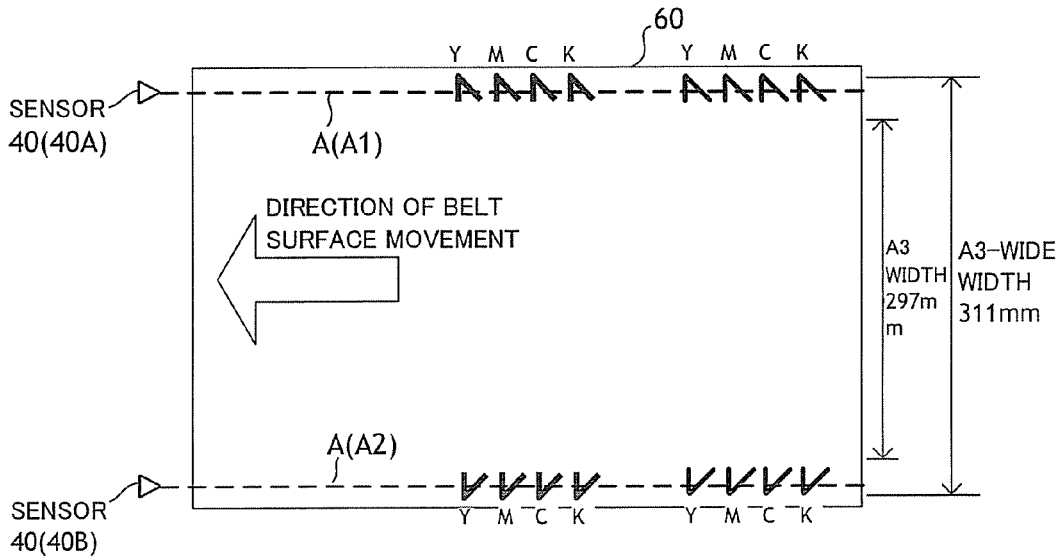
FIG. 8 shows alignment patterns.

FIG. 7 is a flowchart for specifically explaining the alignment. FIG. 8 shows alignment patterns.

After ACT 6, the image control unit 93 of the processor 801, with the image forming unit Q, forms only alignment patterns Y, M, C and K of the individual colors on the belt 60 without forming images of the individual colors (ACT 71) (FIG. 8). The alignment patterns Y, M, C and K of the individual colors are V-shaped. The alignment patterns Y, M, C and K of the individual colors are formed with a shift from each other in the direction of belt surface movement in each detection area A for the sensor 40 set on both lateral sides of the direction of belt width. Four alignment patterns Y, M, C and K of the individual colors form one set. For example, two sets of alignment patterns are formed in each detection area A. A set of alignment patterns in the one detection area A1 and a set of alignment patterns in the other detection area A2 are formed at positions corresponding to each other in the direction of belt surface movement. The sensor 40 detects each alignment pattern and inputs a detection signal to the processor 801.

Figure 9:
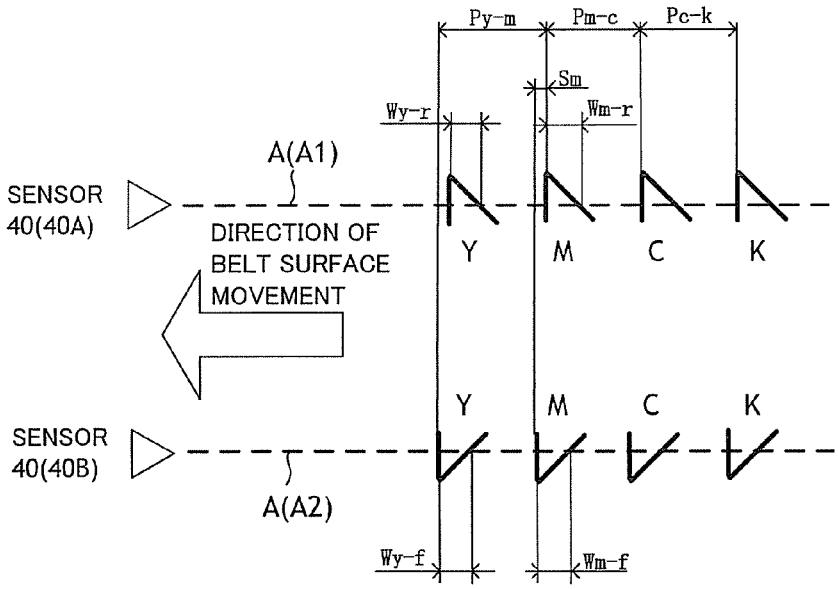
FIG. 9 shows the quantity of shift of images of individual colors appearing in the alignment patterns.

FIG. 9 shows the quantity of shift between the images of the individual colors appearing in the alignment patterns. FIG. 10 shows the type of shift, the quantity of shift, and the target of correction.

After ACT 71, the shift quantity calculating unit 94 calculates the quantity of shift (measuring pitch) indicating the degree of shift between images of the individual colors in the case where the images of the individual colors are formed and superimposed on each other to form a color image by the image forming unit Q, based on the result of the detection of the alignment patterns by the sensor 40 (ACT 72).

Specifically, the shift quantity calculating unit 94 calculates the distances Py-m, Pm-c and Pm-k between the alignment patterns formed in the one detection area A1, based on the result of the detection of the alignment patterns by the sensor 40. The processor 801 calculates the average values of the distances Py-m, Pm-c and Pc-k in each of the two sets of alignment patterns in the detection area A1, as the quantities of shift Py-m, Pm-c and Pc-k. The quantities of shift Py-m, Pm-c and Pc-k represent the shift in parallelism in the sub scanning direction between the images of the individual colors.

The shift quantity calculating unit 94 calculates the distance Wx-r (where x=m, c, k) between the sides of the V-shaped alignment patterns of the individual colors M, C and K, and the distance Wy-r between the sides of the alignment pattern of the color Y, based on the result of the detection of the alignment patterns, and then calculates [Wx-r]−[Wy-r] (where x=m, c, k). The processor 801 calculates [Wx-r]−[Wy-r] (where x=m, c, k) for each of the two sets of alignment patterns in the detection area A1, and calculates the average value of the values calculated for each set, as the quantity of shift [Wx-r]−[Wy-r] (where x=m, c, k). The quantity of shift [Wx-r]−[Wy-r] (where x=m, c, k) represents the shift in parallelism in the main scanning direction of the images of the individual colors (M, C and K) from the image of the color Y.

The shift quantity calculating unit 94 calculates the distance Wx-f (where x=m, c, k) between the sides of the V-shaped alignment patterns formed in the other detection area A2 and the distance Wy-f between the sides of the alignment pattern of the color Y, and then calculates ([Wx-r]+[Wx-f])−([Wy-r]+[Wy-f]) (where x=m, c, k). The alignment patterns in the one detection area A1 are paired with the alignment patterns located at the corresponding position in the other detection area A2 in the direction of belt surface movement. Two of these pairs are formed in the direction of belt surface movement. The processor 801 calculates ([Wx-r]+[Wx-f])−([Wy-r]+[Wy-f]) (where x=m, c, k) for each of the two pairs of alignment patterns and calculates the average value of the values calculated for each pair, as the quantity of shift ([Wx-r]+[Wx-f])−([Wy-r]+[Wy-f]) (where x=m, c, k). The quantity of shift ([Wx-r]+[Wx-f])−([Wy-r]+[Wy-f]) (where x=m, c, k) represents the shift in magnification in the main scanning direction of the images of the individual colors (M, C and K) from the image of the color Y.

The shift quantity calculating unit 94 calculates the shift Sx (where x=m, c, k) in the direction of belt surface movement between the alignment patterns located at the positions corresponding to each other in the direction of belt surface movement. The shift quantity calculating unit 94 calculates Sx (where x=m, c, k) for each of the two pairs of alignment patterns and then calculates the average value of the values calculated for each pair, as the quantity of shift Sx (where x=m, c, k). The quantity of shift Sx (where x=m, c, k) represents the shift in inclination of the images of the individual colors (M, C and K).

After ACT 72, the correction unit 95 corrects the setting of the image control unit 93 with respect to the formation of the color image and the setting of the image forming unit Q with respect to the formation of the color image, based on the quantities of shift, and then carries out alignment between the images of the individual colors formed by the image forming unit Q (ACT 73).

Specifically, the correction unit 95 corrects the setting of the writing start position of the laser of each color in the sub scanning direction stored in the setting storage unit 806, based on the quantities of shift Py-m, Pm-c and Pc-k, so that the shift in parallelism in the sub scanning direction between the images of the individual colors is eliminated.

The correction unit 95 corrects the setting of the writing start position of the laser of each color in the main scanning direction stored in the setting storage unit 806, based on the quantity of shift [Wx-r]−[Wy-r] (where x=m, c, k), so that the shift in parallelism in the main scanning direction between the images of the individual colors is eliminated.

The correction unit 95 corrects the setting of the inclination angle of the reflection mirrors 35 (M, C and K, in FIG. 4) of the laser optical system 30 by controlling the driving of the reflection mirrors 35 (M, C and K) via mirror motors 351 (M, C and K) based on the quantity of shift Sx (where x=m, c, k) so that the shift in inclination between the images of the individual colors is eliminated.

The correction unit 95 corrects the setting of the inclination angle of the reflection mirrors 35 (M, C and K, in FIG. 4) of the laser optical system 30 by controlling the driving of the reflection mirrors 35 (M, C and K) via the mirror motors 351 (M, C and K) based on the quantity of shift Sx (where x=m, c, k) so that the shift in inclination between the images of the individual colors is eliminated.

After ACT 73, the image control unit 93 only forms alignment patterns again on the belt 60 (ACT 74). The shift quantity calculating unit 94 calculates the quantities of shift based on the result of the detection of the alignment patterns by the sensor 40 (ACT 75).

After ACT 75, the determination unit 92 determines whether all the quantities of shift are within a range of prescribed values or not (ACT 76). When the determination unit 92 determines that all the quantities of shift are not within the range of prescribed values (ACT 76, NO), ACT 74 to ACT 76, including the image control unit 93 forming only alignment patterns again on the belt 60, are repeated.

When the determination unit 92 determines that all the quantities of shift are within the range of prescribed values (ACT 76, YES), the image control unit 93 executes the next job and forms a color image on an A3-Wide sheet (ACT 8).

When the alignment is to be performed within a short time, ACT 74 to ACT 76 to make sure that the shift between the images falls within the range of prescribed values may be omitted.

(2) Next, alignment in the case where, when an alignment command is generated by the command generating unit 91, a job for an A3-Wide sheet is being executed and the next job is for a smaller sheet than an A3-Wide sheet, for example, a sheet of the A3 or A4 size, will be described.

In this case, the processor 801 performs alignment simultaneously with the execution of the next job after the currently executed job is finished.

Specifically, ACT 1 to ACT 6 are the same as in the case (1). After the job currently executed by the processor 801 is finished, the size determination unit 921 determines whether the size of the color image of the next job is A3-Wide or not, with reference to the job queue 805 (ACT 6).

When the size determination unit 921 determines that the size of the color image of the next job is A3 or A4 which is smaller than A3-Wide (ACT 6, NO), the processor 801 performs alignment simultaneously with the execution of the next job (ACT 7A).

Figure 11:
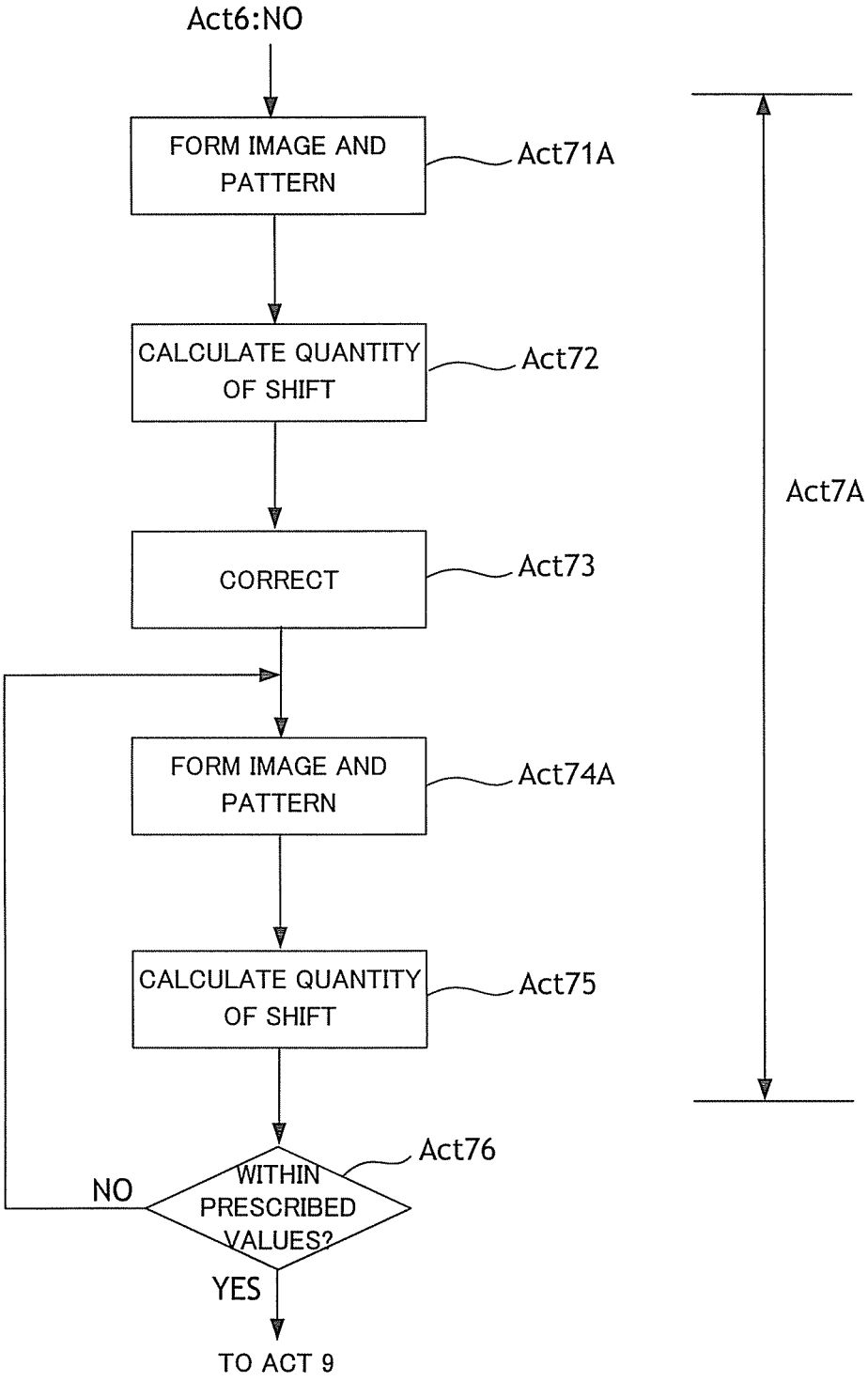
FIG. 11 is a flowchart for specifically explaining the alignment.

FIG. 11 is a flowchart for specifically explaining the alignment.

After ACT 6, the image control unit 93 with the image forming unit Q forms, for example, a color image of the A3 size for the first sheet in the next job, and at the same time, forms alignment patterns on both outer sides of the color image in the direction of belt width (ACT 71A). More specifically, the image control unit 93 forms an image of a predetermined color at a position on the belt 60 that is closer to the belt center than the detection areas A are, more specifically, between the detection areas A1 and A2 in the direction of belt width, and at the same time, forms an alignment pattern of a predetermined color at a position overlapping the detection areas A, for each color, and then superimposes the images of the individual colors to form, for example, a color image of the A3 size for one sheet (FIG. 3). The color image on the belt 60 is transferred to a sheet at the secondary transfer position U. The alignment patterns of the individual colors are formed with a shift from each other in the direction of belt surface movement and are detected by the sensor 40. The alignment patterns are formed outside of the color image of the size corresponding to the transfer target sheet and therefore are not transferred to the sheet.

After ACT 7A, the shift quantity calculating unit 94 calculates each quantity of shift based on the result of the detection of the alignment patterns by the sensor 40, similarly to ACT 72 in (1) (ACT 72).

After ACT 72, the correction unit 95 corrects the setting of the image control unit 93 with respect to the formation of the color image stored in the setting storage unit 806, based on the calculated quantities of shift. The correction unit 95 also corrects the setting of the image forming unit Q with respect to the formation of the color image, based on the calculated quantities of shift. Specifically, the driving of the reflection mirrors 35 (M, C and K) is controlled by the mirror motors 351 and the inclination angle of the reflection mirrors 35 (M, C and K) is corrected (ACT 73).

After ACT 73, the image control unit 93 forms a color image for the second sheet in the job, and at the same time, forms alignment patterns on both outer sides of the color image in the direction of belt width (ACT 74A). The shift quantity calculating unit 94 calculates again the quantities of shift based on the result of the detection of the alignment patterns by the sensor 40 (ACT 75). When the shift quantity calculating unit 94 determines that all the quantities of shift are within the range of prescribed values (ACT 76, YES), the image control unit 93 only forms color images for the third and subsequent sheets in the job without forming alignment patterns (ACT 9).

When it is determined by the determination unit 92 that the job is finished (ACT 10, YES), the processor 801 switches the image forming apparatus 200 to the ready state or executes the next job (ACT 11).

(3) Next, alignment in the case where, when an alignment command is generated by the command generating unit 91 (ACT 1), a job is being executed (ACT 2, YES) and the current executed job is for a smaller-size sheet than an A3-Wide sheet (ACT 3, NO), will be described.

A color image of a smaller size than the A3-Wide size can be formed between the detection areas A1 and A2 in the direction of belt width. Therefore, in the case of forming a color image of a smaller size than the A3-Wide size, alignment patterns can be formed in the detection areas A at the same time as the color image is formed between the detection areas A1 and A2 in the direction of belt width.

Thus, when an alignment command is generated while a job for a smaller-size sheet than an A3-Wide sheet is executed, the processor 801 continues executing the job and forms the color image between the detection areas A1 and A2 with the image forming unit Q, and at the same time, forms the alignment patterns in the detection areas A. Thus, the alignment is performed similarly to ACT 7A (ACT 7B, ACT 76).

(4) Next, alignment in the case where, when an alignment command is generated by the command generating unit 91 (ACT 1), the apparatus is in the ready state (ACT 2, NO) and the job (ACT 12, YES) accepted during the alignment (ACT 7C) is for an A3-Wide sheet (ACT 13, YES), will be described.

Since a color image of the A3-Wide size is formed overlapping the detection areas A on the belt 60, alignment patterns cannot be formed simultaneously with the color image.

Thus, when the job accepted during the alignment that is already being performed in the ready state is for an A3-Wide sheet (ACT 13, YES), the processor 801 continues forming the alignment patterns alone on the belt 60 with the image forming unit Q and thus performs the alignment (FIG. 7, ACT 74). Then, after the alignment is finished (ACT 76, YES), the processor 801 executes the accepted job and forms a color image on an A3-Wide sheet with the image forming unit Q (ACT 8).

(5) Next, alignment in the case where, when an alignment command is generated by the command generating unit 91 (ACT 1), the apparatus is in the ready state (ACT 2, NO) and the job accepted during the alignment (ACT 7C) is for a smaller sheet than an A3-Wide sheet (ACT 13, NO), will be described.

Since a color image of a smaller size than the A3-Wide size can be formed between the detection areas A1 and A2 in the direction of belt width, alignment patterns can be formed in the detection areas A simultaneously with the formation of the color image.

Therefore, when the job accepted during the alignment that is already being performed in the ready state is for a smaller-size sheet than an A3-Wide sheet (ACT 13, NO), the processor 801 executes the accepted job and forms a color image with the image forming unit Q, and at the same time, forms alignment patterns (FIG. 11, ACT 74A). The processor 801 executes the accepted job while continuing to carry out the alignment (ACT 7A).

The operations in the processing by the image forming apparatus 200 can be realized as the processor 801 executes a toner image alignment program stored in the memory 803.

Second Embodiment

Figure 12:
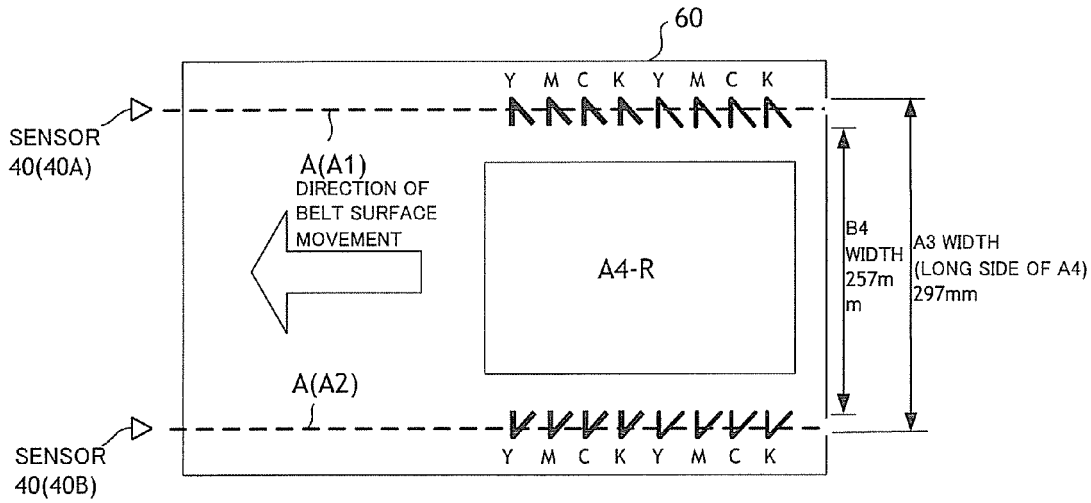
FIG. 12 shows the detection area of the sensors.

FIG. 12 shows the sizes available for the image formation in the image forming apparatus 200 and the detection areas A for the sensor 40. Hereinafter, the same functional parts as in the above embodiment are denoted by the same reference numerals and will not be described further in detail.

In this embodiment, the maximum size available to the image formation by the image forming apparatus 200 is the A3 size. In the direction of belt width, the image forming unit Q can write across the A3 width (297 mm) and the length (297 mm) in the longitudinal direction of A4 (297×210 mm). The detection areas A for the sensor 40 are set outside of the B4 width (257 mm) and inside the A3 width in the direction of belt width.

Color images of the A3 size and A4 size are formed overlapping the detection areas A on the belt 60. Therefore, the processor 801 with the image forming unit Q cannot simultaneously form the color images of the A3 size and the A4 size and alignment patterns that need to be formed in the detection areas A on the belt 60. Meanwhile, the processor 801 with the image forming unit Q can form color images of the A4-R size (the size of A4 turned in the direction of the length of the belt 60) and B4 size, which are smaller than the A3 size and A4 size, between the detection areas A1 and A2 in the direction of belt width on the belt 60. Therefore, the processor 801 with the image forming unit Q can simultaneously form the color images of the A4-R size and B4 size and the alignment patterns.

Figure 13:
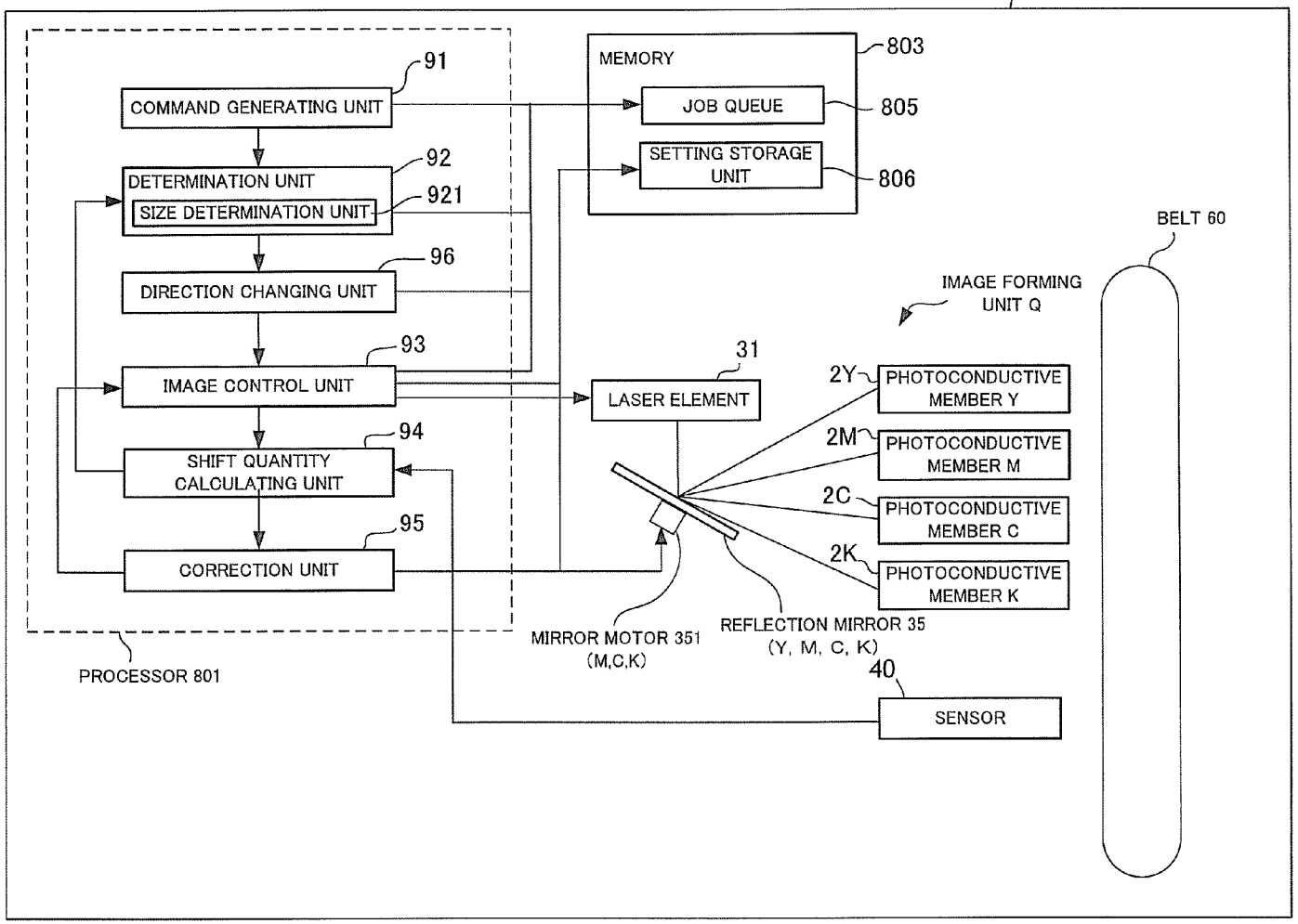
FIG. 13 shows a changing unit.

The image forming apparatus 200 has a direction changing unit 96 as a functional unit realized by the processor 801 (FIG. 13).

Figure 14:
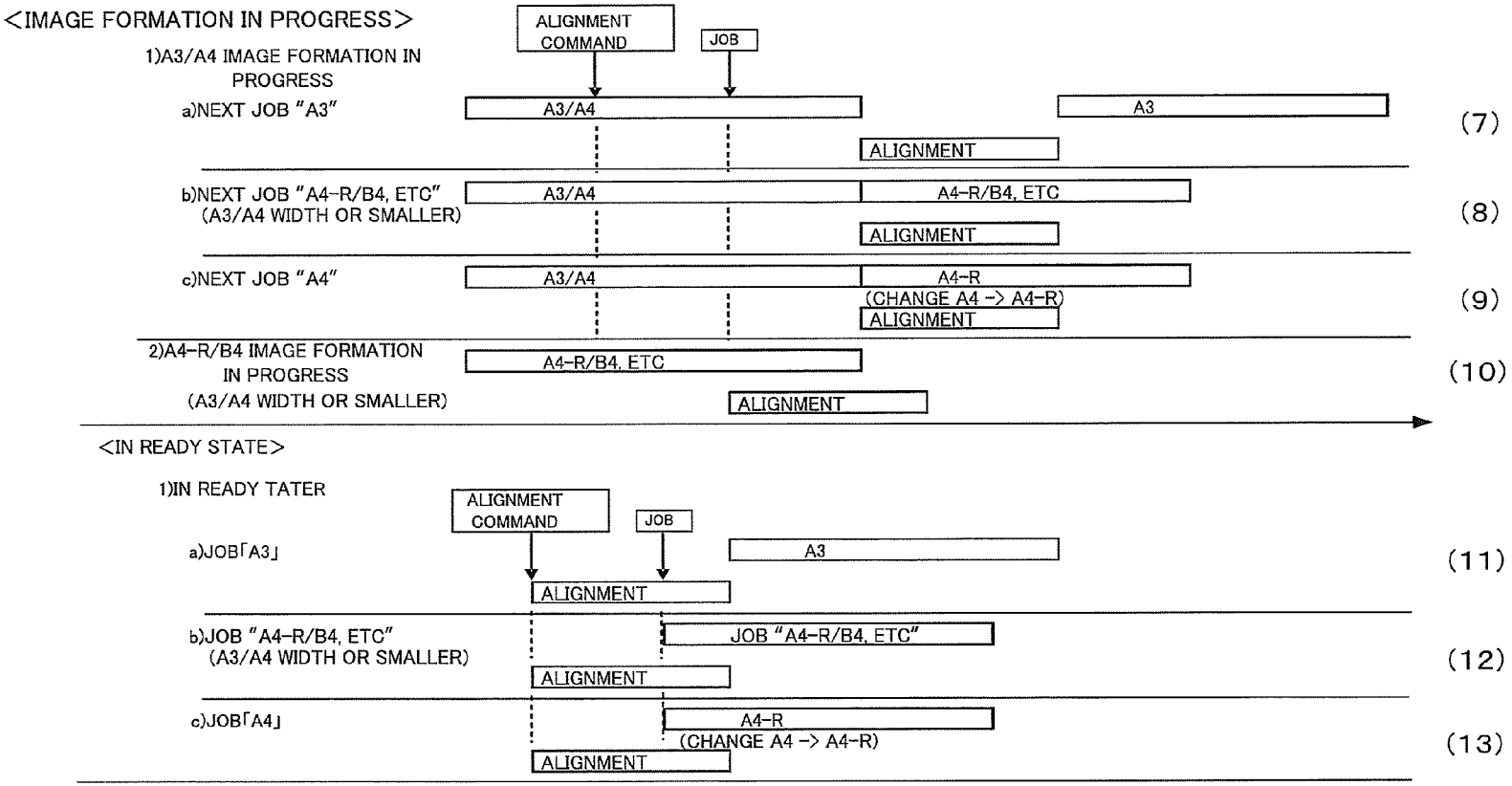
FIG. 14 shows the timing of carrying out the alignment.
Figure 15:
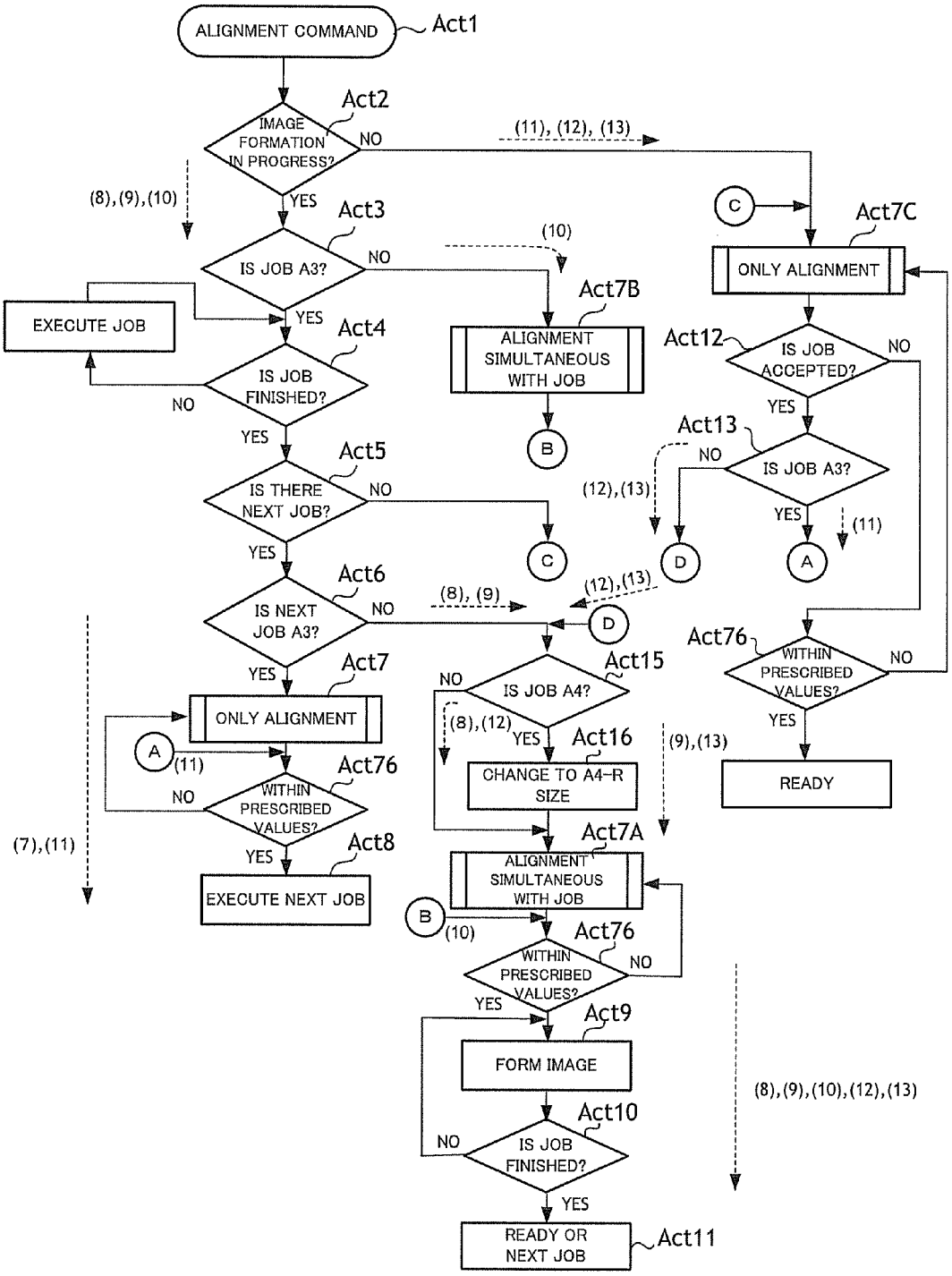
FIG. 15 is a flowchart showing a flow of the alignment by the processor.

FIG. 14 shows the timing of carrying out the alignment. FIG. 15 is a flowchart showing a flow of the alignment by the processor 801.

The alignment is roughly divided into seven cases (7) to (13). Of these cases, the alignment in the cases (7), (8), (10) to (12), excluding (9) and (13) where the job is for an A4 sheet, is similar to the alignment (1) to (5) in the above embodiment except that the maximum size available for image formation is changed from the A3-Wide size to the A3 size, as shown in FIG. 14 and FIG. 15.

(8) Hereinafter, alignment in the case where, when an alignment command is generated by the command generating unit 91, a job for an A3 sheet is being executed and the next job is for an A4 sheet, will be described.

In this case, ACT 1 to ACT 6 are the same as in the case (1) as described above. After the processor 801 finishes the job that is being executed, the size determination unit 921 determines the size of the color image of the next job with reference to the job queue 805 (ACT 6).

When the size determination unit 921 determines that the size of the color image of the next job is A4 (ACT 6, NO; ACT 15, YES), the direction changing unit 96 changes the size of the color image of the next job from A4 to A4-R (ACT 16). In this manner, when the size of the color image of the job determined by the size determination unit 921 is a size such that the color image overlaps the detection areas A but does not overlap the detection areas A if its direction is changed, the direction changing unit 96 changes the direction of the color image of the job to the direction in which the color image does not overlap the detection areas A.

Here, the processor 801 with the image forming unit Q cannot simultaneously form the color image of the A4 size which overlaps the detection areas A for the sensor 40 and alignment patterns that need to be formed in the detection areas A. However, the processor 801 can simultaneously form the color image of the A4-R size that can fit between the detection areas A1 and A2 in the direction of belt width and the alignment patterns on the belt 60.

Therefore, after ACT 16 where the size of the color image of the next job is changed from A4 to A4-R, the processor 801 with the image forming unit Q executes the job for an A4-R sheet and forms the color image of the A4-R size between the detection areas A1 and A2 in the direction of belt width. Simultaneously, the processor 801 with the image forming unit Q forms the alignment patterns in the detection areas A and executes alignment, similarly to ACT 7A in the case (2) of the above embodiment (ACT 7A, ACT 76). The subsequent ACT 9 to ACT 11 are similar to ACT 9 to ACT 11 in the case (2) of the above embodiment.

(12) Next, alignment in the case where, when an alignment command is generated by the command generating unit 91 (ACT 1), the apparatus is in the ready state (ACT 2, NO) and a job accepted during alignment after that is for an A4 sheet (ACT 12, YES; ACT 13, NO; ACT 15, YES), will be described. The processor 801 with the image forming unit Q cannot simultaneously form a color image of the A4 size which overlaps the detection areas A for the sensor 40 and alignment patterns that need to be formed in the detection areas A, on the belt 60.

Therefore, the direction changing unit 96 changes the setting for the accepted job from the setting of A4-sheet to the setting of A4-R sheet (ACT 16). After that, the processor 801 executes the job for an A4-R sheet, and with the image forming unit Q, forms the color image of the A4-R size between the detection areas A1 and A2 in the direction of belt width on the belt 60. Simultaneously, the processor 801 forms the alignment patterns in the detection areas A with the image forming unit Q and performs alignment, similarly to ACT 7A in the case (2) of the above embodiment (ACT 7A, ACT 76).

Third Embodiment

Figure 16:
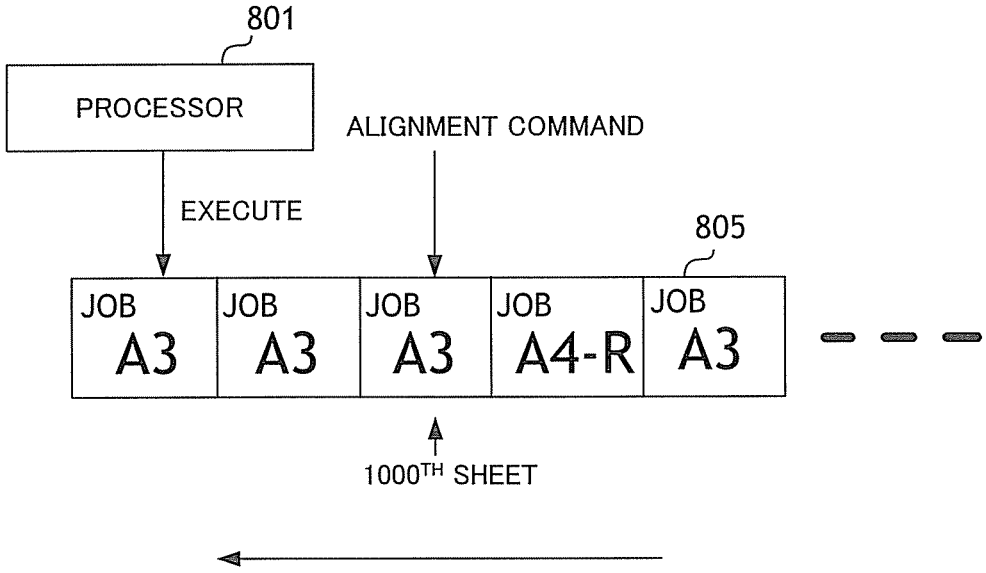
FIG. 16 shows a job queue.

FIG. 16 shows the job queue 805.

In this embodiment, the processor 801 shifts the timing of executing alignment to timing when the processor 801 can carry out alignment simultaneously with a job, with reference to the job queue 805. Hereinafter, the embodiment will be described specifically.

Figure 17:
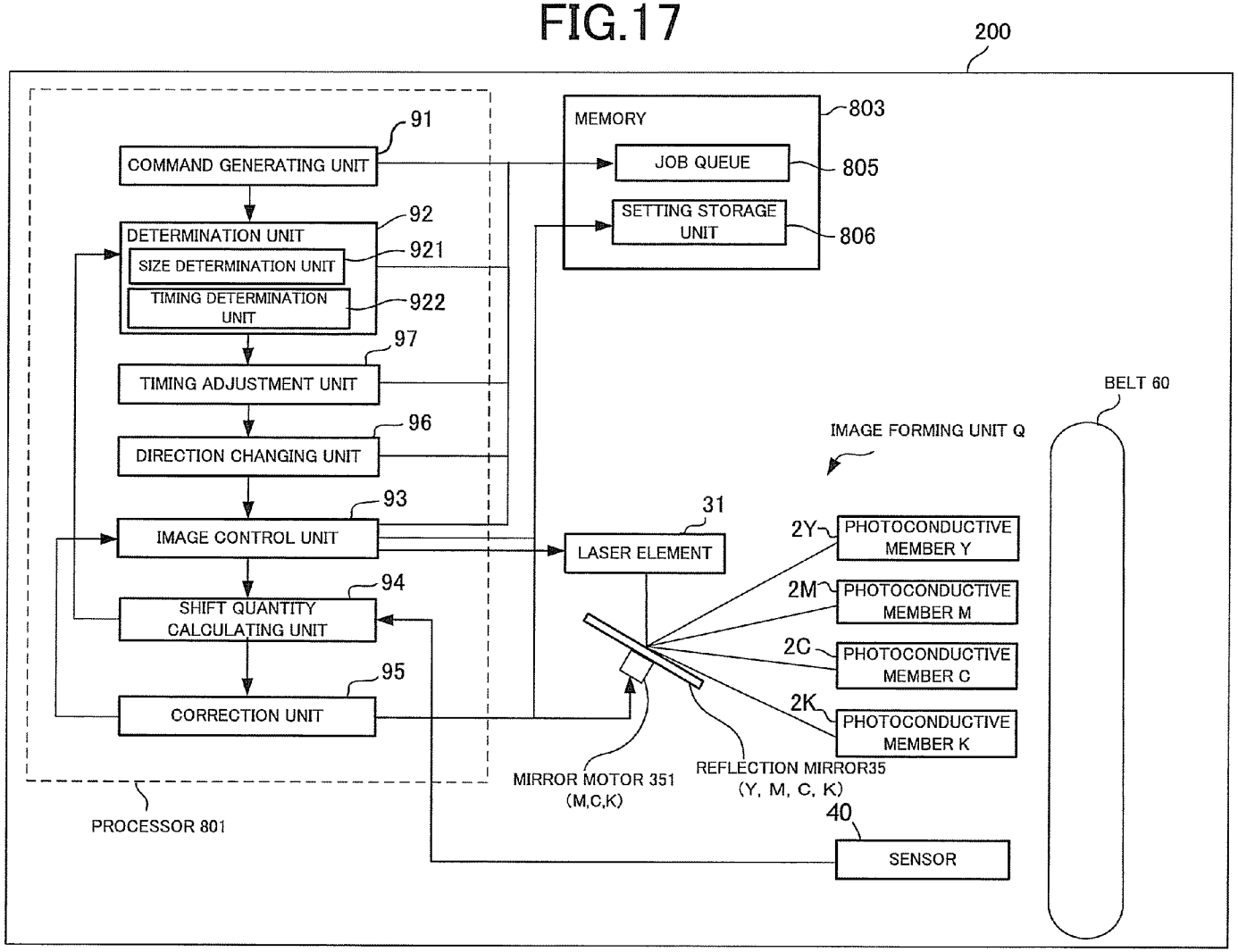
FIG. 17 shows a timing determination unit and a timing adjustment unit.

The job queue 805 is provided in the memory 803. The job queue 805 stores accepted jobs in the order of acceptance. The job queue 805 stores the contents of the jobs and the order of the jobs. The processor 801 executes the jobs in order from the highest-ranking job (in FIG. 16, the job on the left) stored in the job queue 805 and deletes the already executed job from the job queue 805. The maximum size available to image formation by the image forming apparatus 200 is the A3 size. The image forming apparatus 200 cannot simultaneously carry out a job for an A3 sheet and alignment. However, the image forming apparatus 200 can simultaneously carry out a job for a sheet of the A4 or smaller size and alignment. In the case of a job for an A4 sheet, the image forming apparatus 200 changes the job to a job for A4-R and then simultaneously carries out the execution of the job and alignment. The image forming apparatus 200 has a timing determination unit 922 and a timing adjustment unit 97 (FIG. 17) as functional units realized by the processor 801.

Figure 18:
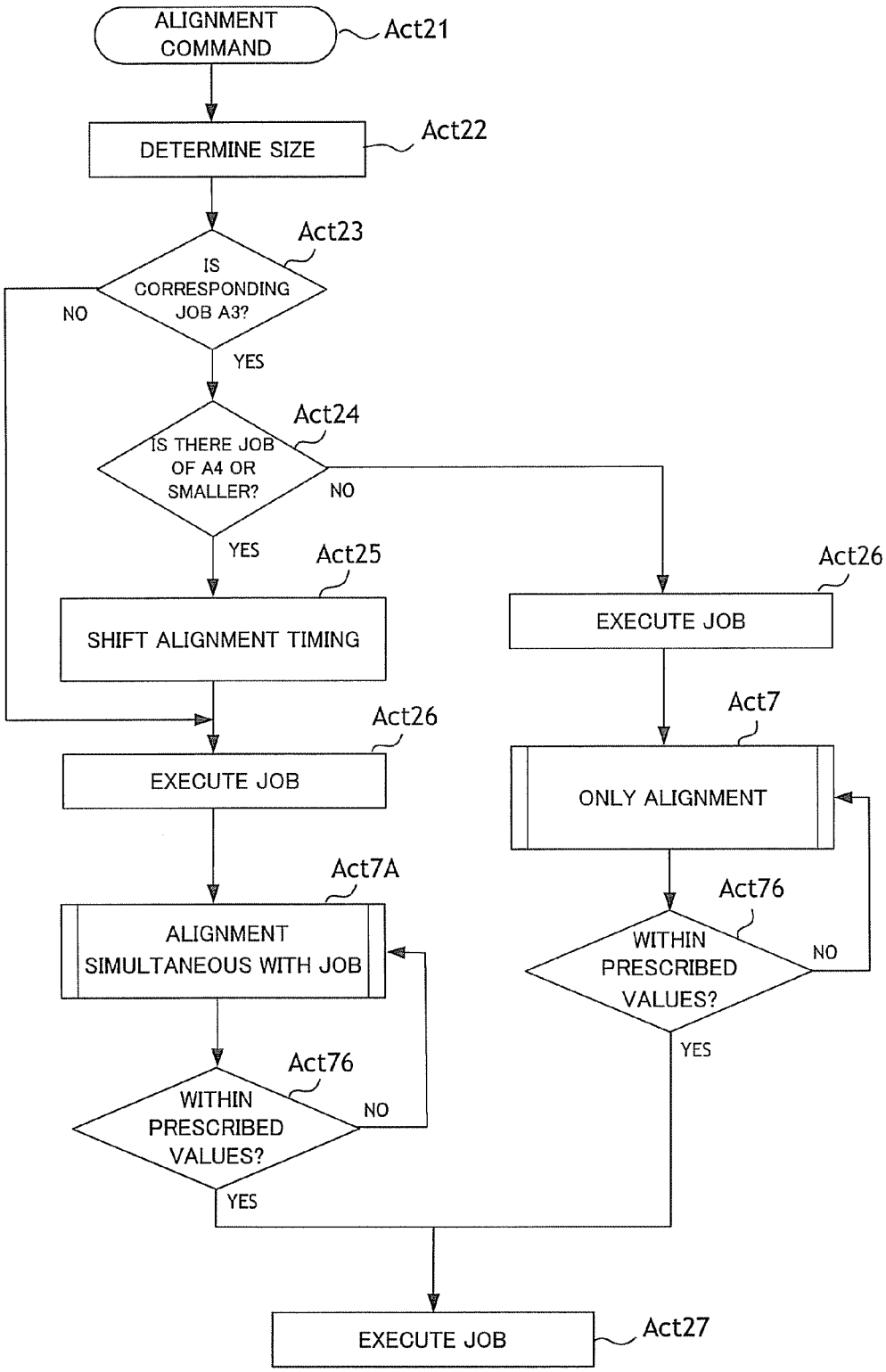
FIG. 18 is a flowchart showing processing to shift the timing of executing the alignment.

FIG. 18 is a flowchart showing a flow of shifting the timing of executing alignment.

The alignment command generating unit 91 totals the numbers of image forming sheets generated by the execution of jobs, with reference to the job queue 805. Then, when the total number of image forming sheets reaches, for example, 1000, the command generating unit 91 generates an alignment command to designate that alignment should be carried out at timing when the number of sheets 1000 is reached (ACT 21). The total number of image forming sheets with which the alignment timing is generated can be changed by setting operation on the operation display unit 800.

After ACT 21, the size determination unit 921 determines the size of the color image of the job with reference to the job queue 805 (ACT 22).

After ACT 22, the timing determination unit 922 determines whether or not the timing designated by the alignment command overlaps the timing of executing a job of forming, for example, an A3-size color image which overlaps the detection areas A (ACT 23).

Figure 19:
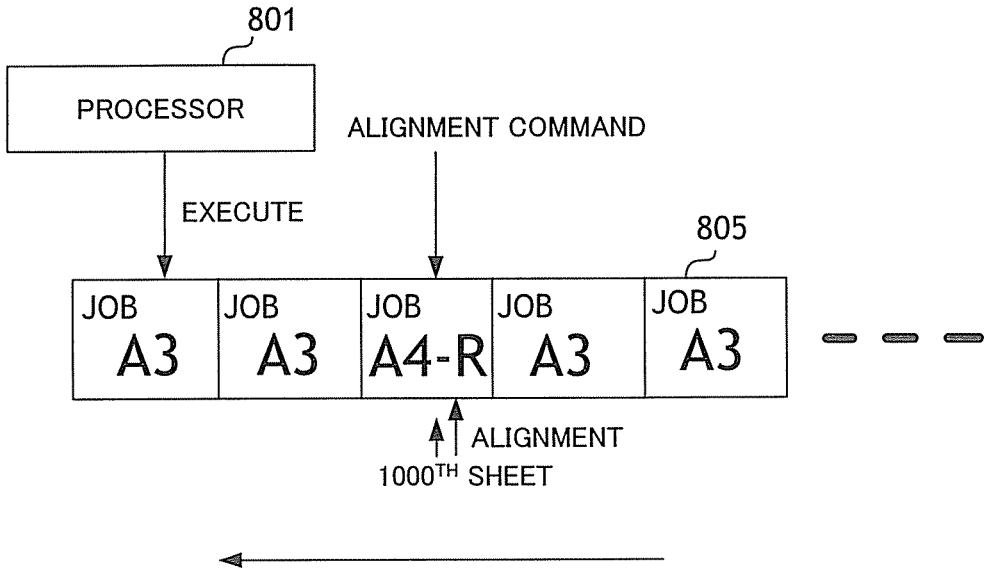
FIG. 19 shows the timing indicated by an alignment command.

When the timing determination unit 922 determines that the timing designated by the alignment command does not overlap the timing of executing a job of forming an A3-size color image which overlaps the detection areas A (ACT 23, NO) (FIG. 19), the processor 801 executes a job preceding, for example, the job for an A4-R sheet (FIG. 19) to be executed in the timing designated by the alignment command (ACT 26).

After ACT 26, the processor 801 executes the job for an A4-R sheet at the timing when the total number of image forming sheets reaches 1000, and with the image forming unit Q, forms a color image of the A4-R size between the detection areas A1 and A2 in the direction of belt width on the belt 60. Simultaneously, the processor 801 with the image forming unit Q forms alignment patterns in the detection areas A and executes alignment, similarly to ACT 7A in the case (2) of the first embodiment (ACT 7A, ACT 76).

When the timing determination unit 922 determines that the timing designated by the alignment command overlaps the timing of executing a job of forming an A3-size color image which overlaps the detection areas A (ACT 23, YES) (FIG. 20), the determination unit 92 determines whether or not a prescribed range of jobs before and after this job (for example, five jobs preceding and following the job to be executed when the number of sheets 1000 is reached) includes a job for an A4-size or smaller sheet, with reference to the job queue 805 (ACT 24).

Figure 20:
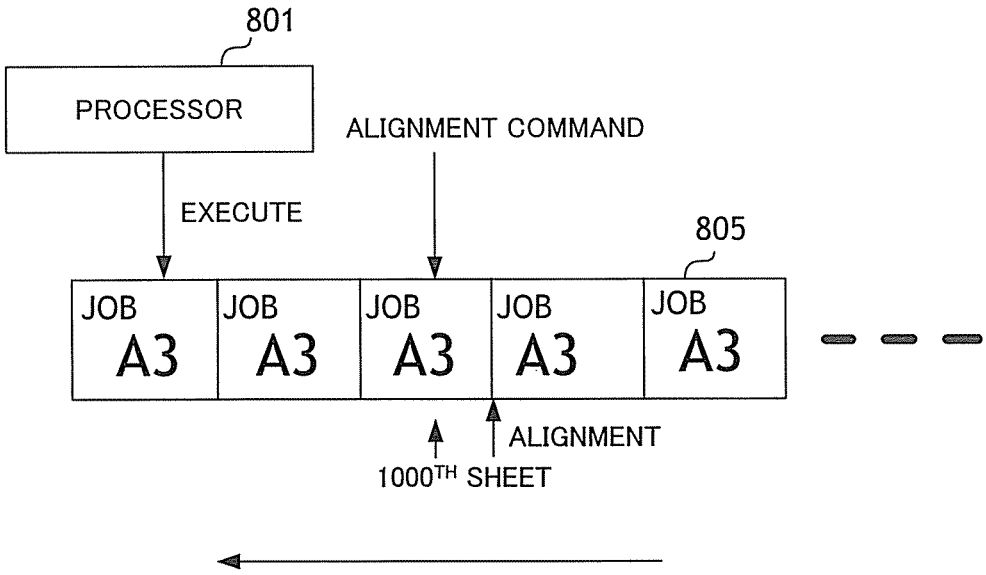
FIG. 20 shows the timing of executing the alignment.

When it is determined that the prescribed range of jobs preceding and following the job to be executed when the total number of image forming sheets reaches 1000 does not include a job for an A4-size or smaller sheet (ACT 24, NO), the determination unit 92 executes jobs up to the job to be executed when the total number of image forming sheets reaches 1000 (ACT 26). After that, the processor 801 only forms alignment patterns on the belt 60 and carries out alignment without executing any job, that is, without forming any color image, similarly to ACT 7 in the case (1) of the first embodiment (ACT 7, ACT 76) (FIG. 20). After the alignment is finished (ACT 76, YES), the processor 801 executes the next job (ACT 27).

Figure 21:
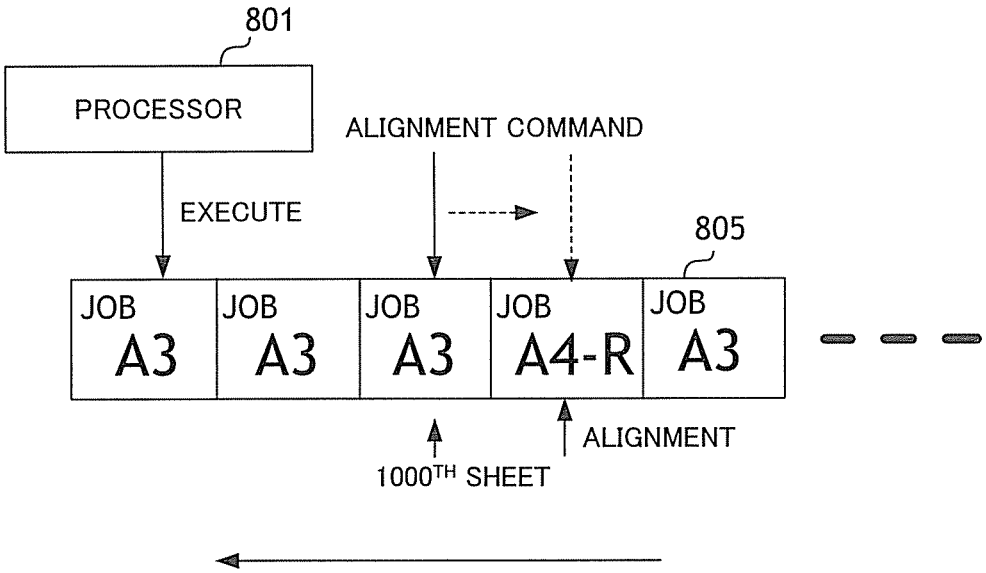
FIG. 21 shows that the alignment command is shifted.

When the determination unit 92 determines in ACT 24 that the prescribed range of jobs preceding and following the job to be executed when the total number of image forming sheets reaches 1000 (for example, five jobs preceding and following the job to be executed when the number of sheets 1000 is reached) includes a job for an A4-size or smaller sheet (ACT 24, YES) (FIG. 21), the timing adjustment unit 97 shifts the designation of the alignment command, that is, the timing of executing alignment to timing of executing the job for an A4-size or smaller sheet (ACT 25) (FIG. 21). The processor 801 with the image forming unit Q can simultaneously carry out the job for an A4-size or smaller sheet and the alignment. Therefore, after executing the job preceding the job for an A4-size or smaller sheet (ACT 26), the processor 801 can simultaneously carry out the execution of the job for an A4-size or smaller sheet, for example, an A4-R sheet, and the alignment (ACT 7, ACT 76).

When the job to be executed is for an A4 sheet in ACT 7A, the image forming apparatus 200 changes the job to be executed to a job for an A4-R sheet and then simultaneously caries out the execution of the job and alignment, similarly to ACT 16 in the case (8) in the second embodiment.

Fourth Embodiment

Figure 22:
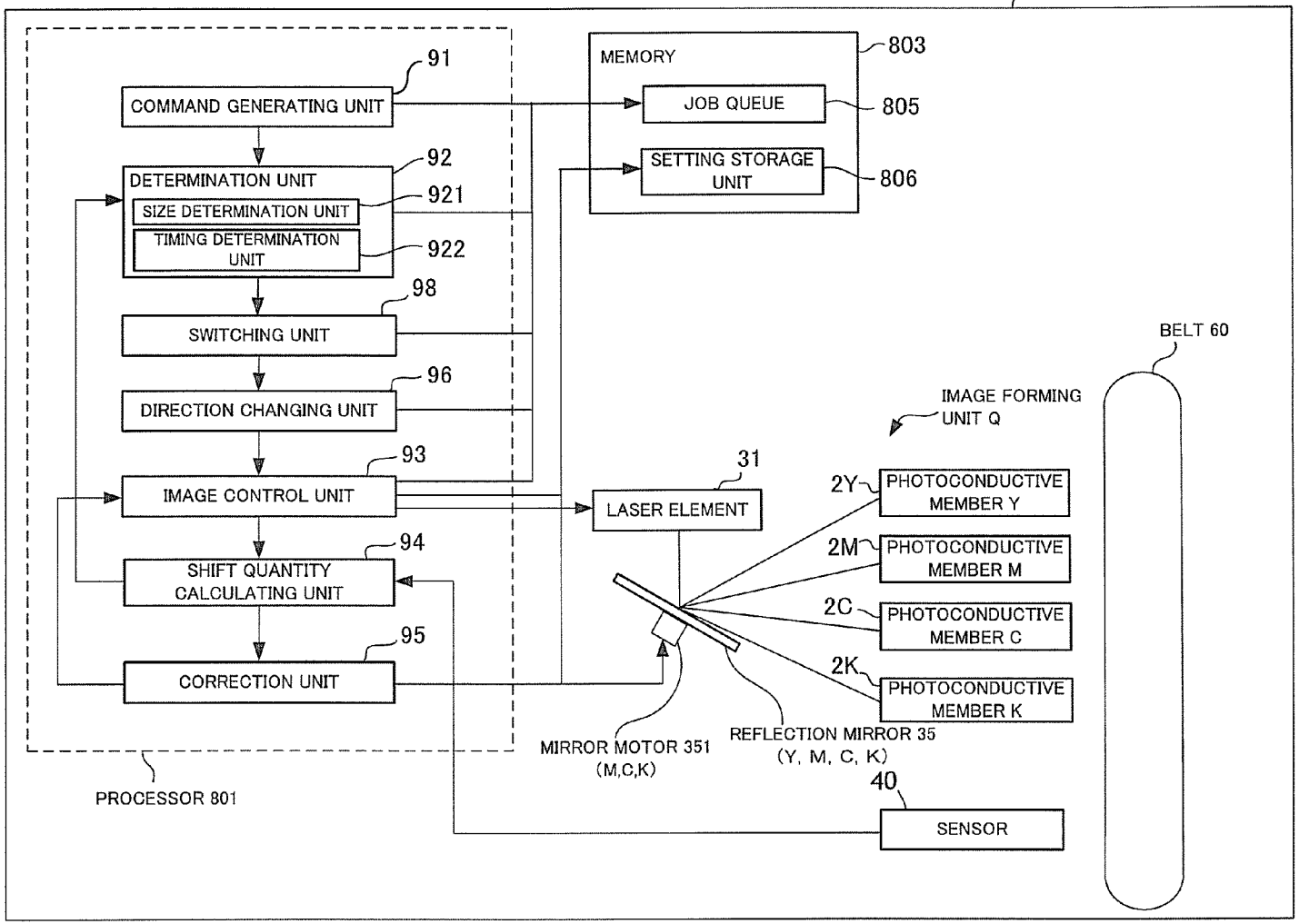
FIG. 22 shows a switching unit.
Figure 23:
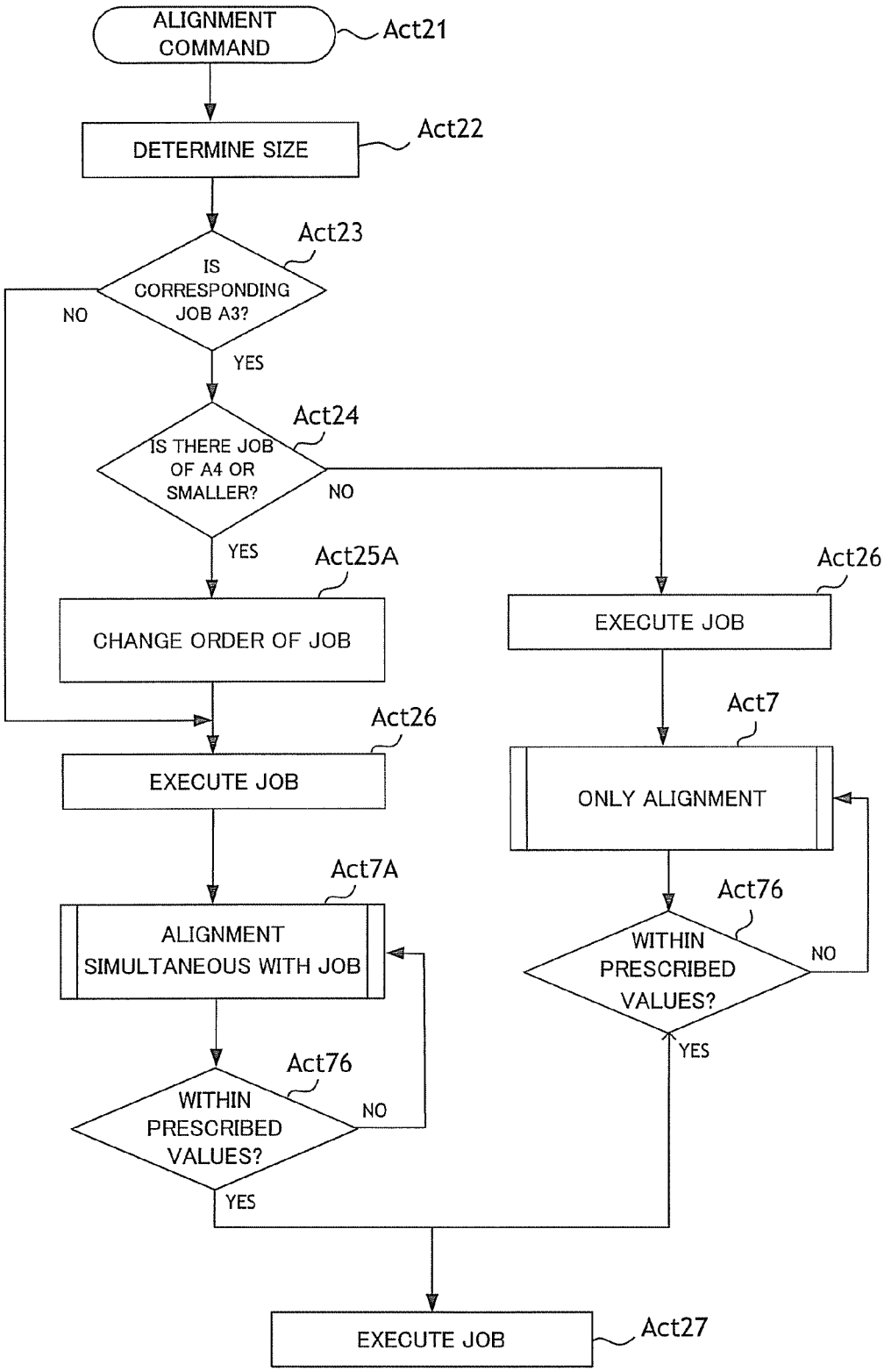
FIG. 23 is a flowchart showing the processing to switch the order of jobs.

FIG. 22 shows a switching unit 98 as a functional unit realized by the processor 801. FIG. 23 is a flowchart showing a flow of switching the order of jobs.

In this embodiment, the image forming apparatus 200 cannot simultaneously carry out a job for an A3 sheet and alignment. However, the image forming apparatus 200 can simultaneously carryout a job for an A4-size or smaller sheet and alignment. In the case of a job for an A4 sheet, the image forming apparatus 200 changes the job to a job for A4-R and then simultaneously carries out the execution of the job and alignment.

Figure 24:
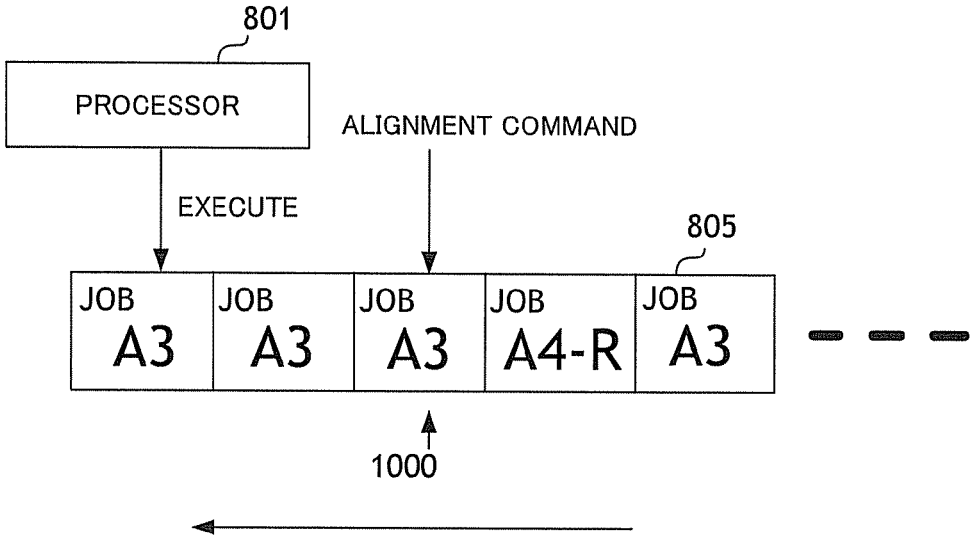
FIG. 24 shows the order of jobs.
Figure 25:
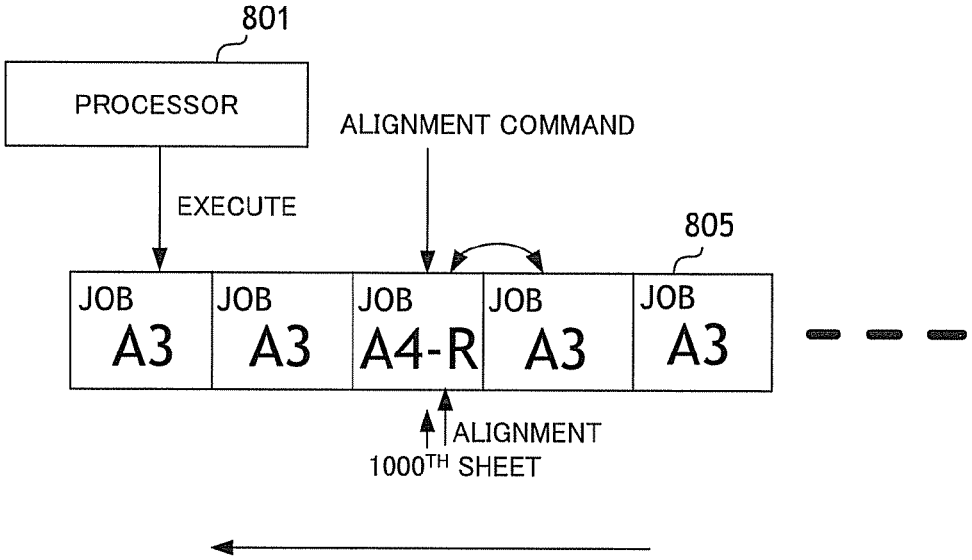
FIG. 25 shows that the order of jobs is switched.

In this embodiment, a similar flow of processing to the third embodiment is employed. However, in this embodiment, in ACT 24, the determination unit 92 determines that the prescribed range of jobs preceding and following the job to be executed when the total number of image forming sheets reaches 1000 includes a job for an A4-size or smaller sheet, for example, an A4-R sheet (ACT 24, YES) (FIG. 24). Then, the switching unit 98 switches the order between the job to be executed when the total number of image forming sheets reaches 1000 and the job for an A4-size or smaller sheet, for example, an A4-R sheet (ACT 25A) (FIG. 25).

Thus, after executing the job preceding the job for an A4-R sheet (ACT 26), the processor 801 with the image forming unit Q can simultaneously carry out the execution of the job for an A4-R sheet and alignment when the total number of image forming sheets reaches 1000 (ACT 7A, ACT 76).

Modification

The detection areas A for the sensor 40 may be set only on one side in the direction of belt width.

The order of alignment patterns may also be KCMY from the leading end in the belt turning direction. An appropriate order may be employed.

The recording medium may be in any form as long as the recording medium can store a program and can be read by a computer. Specifically, the recording medium may be, for example, an internal storage device internally arranged in a computer such as ROM or RAM, a portable storage medium such as CD-ROM, flexible disk, DVD disk, magneto-optical disk or IC card, a database holding a computer program, or another computer and its database. The functions acquired by installing or downloading may be realized in cooperation with the OS (operating system) within the apparatus. A part or the entirety of the program may include execution modules that are dynamically generated.

Moreover, as a matter of course, at least a part of the various kinds of processing realized by the execution of the program by the processor in the embodiments can be executed via a circuit configuration in the ASIC 802.

As described above in detail, the technique described in the specification can provide an image forming apparatus, an alignment pattern forming method, and a computer-readable recording medium having a toner image alignment program recorded therein.

While certain embodiments have been described, these embodiments have been presented by way of example only, and are not intended to limit the scope of the invention. Indeed, the novel apparatus and methods and computer-readable medium described herein may be embodied in a variety of other forms. Furthermore, various omissions, substitutions and changes in the form of the apparatus and methods and computer-readable medium described herein may be made without departing from the spirit of the invention. The accompanying claims and their equivalents are intended to cover such forms or modifications as would fall within the scope and spirit of the invention.

What is claimed is:

1. An image forming apparatus comprising:

an image forming unit which forms a toner image made up of toners of plural colors;

a belt which transfers to a sheet the toner image transferred to a belt surface by the image forming unit;

a sensor whose detection area for the toner image is set closely to at least one end part in a direction of belt width orthogonal to a direction of belt surface movement, on the belt; and an image control unit which controls the image forming unit to form the toner image to be transferred to the sheet in a range different from the detection area in the direction of belt width, and to form plural alignment patterns for toner image alignment made up of toners of different colors from each other at a position which is within a range where the toner image is formed in the direction of belt surface movement and which overlaps the detection area in the direction of belt width.

2. The apparatus according to claim 1, further comprising:

a size determination unit which determines a size of an image of a job; and a direction changing unit which, when the size of the image of the job determined by the size determination unit is a size such that the image overlaps the detection area and that the image does not overlap the detection area when its direction is changed, changes the direction of the image of the job to a direction in which the image does not overlap the detection area.

3. The apparatus according to claim 1, further comprising:

a storage unit which stores a job and order of executing the job;

a size determination unit which determines a size of an image of the job with reference to the storage unit;

a timing determination unit which determines whether or not timing of forming the alignment patterns overlaps timing of executing a job of forming an image of a size such that the image overlaps the detection area, with reference to the storage unit; and a timing adjustment unit which, when the timing determination unit determines that the timing of forming the alignment patterns overlaps the timing of executing the job of forming an image of a size such that the image overlaps the detection area, shifts the timing of forming the alignment patterns to timing of executing a job of forming an image of a size such that the image does not overlap the detection area.

4. The apparatus according to claim 1, further comprising:

a storage unit which stores a job and order of executing the job;

a size determination unit which determines a size of an image of the job with reference to the storage unit;

a timing determination unit which determines whether or not timing of forming the alignment patterns overlaps timing of executing a job of forming an image of a size such that the image overlaps the detection area, with reference to the storage unit; and a switching unit which, when the timing determination unit determines that the timing of forming the alignment patterns overlaps the timing of executing the job of forming an image of a size such that the image overlaps the detection area, switches the order between the job of forming an image of a size such that the image overlaps the detection area and a job of forming a color image of a size such that the image does not overlap the detection area.

5. The apparatus according to claim 1, wherein the detection area is set on both sides in the direction of the width of the belt, and the alignment patterns are formed respectively at a position overlapping each of the detection areas on both sides in the direction of the width of the belt.

6. The apparatus according to claim 5, wherein the image forming unit includes:

a light source which emits a laser beam;

a polygon mirror which reflects the laser beam emitted from the light source;

reflection mirrors, three for each color, which reflect the laser beam reflected by the polygon mirror;

a photoconductive member for each color on which a toner image of a predetermined color is formed after being exposed to the laser beam reflected by the reflection mirrors, and from which the toner image is transferred to the belt; and a driving unit which drives a reflection mirror for each color that reflects the laser beam for the third time, of the reflection mirrors;

wherein the apparatus includes a correction unit which controls the driving unit based on a result of detection of the alignment patterns by the sensor and corrects an inclination angle of the reflection mirror for each color that reflects the laser beam for the third time, of the reflection mirrors.

7. The apparatus according to claim 1, wherein the alignment patterns are V-shaped.

8. An alignment pattern forming method for toner image alignment in an image forming apparatus having an image forming unit which forms a toner image made up of toners of plural colors, a belt which transfers to a sheet the toner image transferred to a belt surface by the image forming unit, and a sensor whose detection area for the toner image is set closely to at least one end part in a direction of belt width orthogonal to a direction of belt surface movement, on the belt, the method comprising:

forming the toner image to be transferred to the sheet in a range different from the detection area in the direction of belt width, and forming plural alignment patterns made up of toners of different colors from each other at a position which is within a range where the toner image is formed in the direction of belt surface movement and which overlaps the detection area in the direction of belt width.

9. The method according to claim 8, wherein a size of an image of a job is determined, and when the size of the image of the job that is determined is a size such that the image overlaps the detection area and that the image does not overlap the detection area when its direction is changed, the direction of the image of the job is changed to a direction in which the image does not overlap the detection area.

10. The method according to claim 8, wherein a job and order of executing the job are stored, a size of an image of the job is determined, it is determined whether or not timing of forming the alignment patterns overlaps timing of executing a job of forming an image of a size such that the image overlaps the detection area, and when it is determined that the timing of forming the alignment patterns overlaps the timing of executing the job of forming an image of a size such that the image overlaps the detection area, the timing of forming the alignment patterns is shifted to timing of executing a job of forming an image of a size such that the image does not overlap the detection area.

11. The method according to claim 8, wherein a job and order of executing the job are stored, a size of an image of the job is determined, it is determined whether or not timing of forming the alignment patterns overlaps timing of executing a job of forming an image of a size such that the image overlaps the detection area, and when it is determined that the timing of forming the alignment patterns overlaps the timing of executing the job of forming an image of a size such that the image overlaps the detection area, the order is switched between the job of forming an image of a size such that the image overlaps the detection area and a job of forming an image of a size such that the image does not overlap the detection area.

12. The method according to claim 8, wherein the detection area is set on both sides in the direction of the width of the belt, and the alignment patterns are formed respectively at a position overlapping each of the detection areas on both sides in the direction of the width of the belt, by the image forming unit.

13. The method according to claim 8, wherein the image forming unit include:

a light source which emits a laser beam;

a polygon mirror which reflects the laser beam emitted from the light source;

reflection mirrors, three for each color, which reflect the laser beam reflected by the polygon mirror; and a photoconductive member for each color on which a toner image of a predetermined color is formed after being exposed to the laser beam reflected by the reflection mirrors, and from which the toner image is transferred to the belt; and wherein based on a result of detection of the alignment patterns by the sensor, an inclination angle of a reflection mirror for each color that reflects the laser beam for the third time, of the reflection mirrors, is changed to correct a shift in inclination between the toner images of the individual colors to be transferred to the sheet.

14. The method according to claim 8, wherein the alignment patterns are V-shaped.

15. A computer-readable recording medium having a toner image alignment program recorded therein which causes a computer to execute alignment of a toner image in an image forming apparatus having an image forming unit which forms a toner image made up of toners of plural colors, a belt which transfers to a sheet the toner image transferred to a belt surface by the image forming unit, and a sensor whose detection area for the toner image is set closely to at least one end part in a direction of belt width orthogonal to a direction of belt surface movement, on the belt, the recording medium having the toner image alignment program recorded therein causing the computer to execute:

forming the toner image to be transferred to the sheet in a range different from the detection area in the direction of belt width, and forming plural alignment patterns for toner image alignment made up of toners of different colors from each other at a position which is within a range where the toner image is formed in the direction of belt surface movement and which overlaps the detection area in the direction of belt width; and correcting at least one of setting related to the formation of the toner image to be transferred to the sheet and setting of the image forming unit related to the formation of the toner image to be transferred to the sheet, based on a result of detection of the alignment patterns by the sensor.

16. The recording medium according to claim 15, having the toner image alignment program recorded therein, the program causing the computer to execute:

determining a size of an image of a job; and when the size of the image of the job that is determined is a size such that the image overlaps the detection area and that the image does not overlap the detection area when its direction is changed, changing the direction of the image of the job to a direction in which the image does not overlap the detection area.

17. The recording medium according to claim 15, having the toner image alignment program recorded therein, the program causing the computer to execute:

storing a job and order of executing the job;

determining a size of an image of the job;

determining whether or not timing of forming the alignment patterns overlaps timing of executing a job of forming an image of a size such that the image overlaps the detection area; and when it is determined that the timing of forming the alignment patterns overlaps the timing of executing the job of forming an image of a size such that the image overlaps the detection area, shifting the timing of forming the alignment patterns to timing of executing a job of forming an image of a size such that the image does not overlap the detection area.

18. The recording medium according to claim 15, having the toner image alignment program recorded therein, the program causing the computer to execute:

storing a job and order of executing the job;

determining a size of an image of the job;

determining whether or not timing of forming the alignment patterns overlaps timing of executing a job of forming an image of a size such that the image overlaps the detection area; and when it is determined that the timing of forming the alignment patterns overlaps the timing of executing the job of forming an image of a size such that the image overlaps the detection area, switching the order between the job of forming an image of a size such that the image overlaps the detection area and a job of forming an image of a size such that the image does not overlap the detection area.

19. The recording medium according to claim 15, having the toner image alignment program recorded therein, wherein the detection area is set on both sides in the direction of the width of the belt, and the toner image alignment program causes the computer to execute formation of the alignment patterns respectively at a position overlapping each of the detection areas on both sides in the direction of the width of the belt, by the image forming unit.

20. The recording medium according to claim 15, having the toner image alignment recorded therein, wherein the image forming unit includes:

a light source which emits a laser beam;

a polygon mirror which reflects the laser beam emitted from the light source;

reflection mirrors, three for each color, which reflect the laser beam reflected by the polygon mirror; and a photoconductive member for each color on which a toner image of a predetermined color is formed after being exposed to the laser beam reflected by the reflection mirrors, and from which the toner image is transferred to the belt; and wherein the toner image alignment program causes the computer to execute, based on a result of detection of the alignment patterns by the sensor, change of an inclination angle of a reflection mirror for each color that reflects the laser beam for the third time, of the reflection mirrors, to correct a shift in inclination between the toner images of the individual colors to be transferred to the sheet.

* * * * *